US006629909B1

(12) United States Patent
Stearns et al.

(10) Patent No.: US 6,629,909 B1
(45) Date of Patent: Oct. 7, 2003

(54) ELLIPTICAL EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/638,099

(22) Filed: Aug. 11, 2000

Related U.S. Application Data

(63) Continuation-in-part of application No. 09/510,029, filed on Feb. 22, 2000, now Pat. No. 6,338,698, which is a continuation-in-part of application No. 09/072,765, filed on May 5, 1998, now Pat. No. 6,171,215, which is a continuation-in-part of application No. 09/064,393, filed on Apr. 22, 1998, now Pat. No. 5,882,281, which is a continuation of application No. 09/064,368, filed on Apr. 22, 1998, now Pat. No. 6,027,431, which is a continuation-in-part of application No. 08/949,508, filed on Oct. 14, 1997, now abandoned, which is a continuation-in-part of application No. 08/839,990, filed on Apr. 24, 1997, now Pat. No. 5,893,820, which is a continuation-in-part of application No. 08/839,991, filed on Apr. 24, 1997, now Pat. No. 5,803,871, which is a continuation-in-part of application No. 09/678,352, filed on Oct. 3, 2000, which is a continuation-in-part of application No. 09/066,143, filed on Apr. 24, 1998, now Pat. No. 6,126,574.

(60) Provisional application No. 60/148,304, filed on Aug. 11, 1999.

(51) Int. Cl.[7] ..... A63B 22/00

(52) U.S. Cl. ..... 482/52; 482/57

(58) Field of Search ..... 482/51, 52, 53, 482/57, 70, 79, 80

(56) References Cited

U.S. PATENT DOCUMENTS

| | | | | |
|---|---|---|---|---|
| 4,185,622 A | | 1/1980 | Swenson | 128/25 B |
| 4,509,742 A | | 4/1985 | Cones | 482/57 |
| 4,786,050 A | | 11/1988 | Geschwender | 272/73 |
| 5,039,088 A | | 8/1991 | Shifferaw | 482/51 |
| 5,186,697 A | | 2/1993 | Rennex | 482/52 |
| 5,242,343 A | | 9/1993 | Miller | 482/57 |
| 5,279,529 A | | 1/1994 | Eschenbach | 48/57 |
| 5,295,928 A | | 3/1994 | Rennex | 482/52 |
| 5,352,169 A | | 10/1994 | Eschenbach | 482/57 |
| 5,383,829 A | | 1/1995 | Miller | 482/57 |
| 5,423,729 A | | 6/1995 | Eschenbach | 482/70 |
| 5,453,066 A | | 9/1995 | Richter, Jr. | 482/57 |
| 5,518,473 A | * | 5/1996 | Miller | 482/57 |
| 5,529,554 A | | 6/1996 | Eschenbach | 482/57 |
| 5,529,555 A | | 6/1996 | Rodgers, Jr. | 482/57 |
| 5,540,637 A | | 7/1996 | Rodgers, Jr. | 482/52 |
| 5,549,526 A | | 8/1996 | Rodgers, Jr. | 482/57 |
| 5,562,574 A | | 10/1996 | Miller | 482/51 |
| 5,573,480 A | | 11/1996 | Rodgers, Jr. | 482/57 |
| 5,573,481 A | | 11/1996 | Pieurcy et al. | 482/57 |
| 5,577,985 A | | 11/1996 | Miller | 482/51 |
| 5,637,058 A | | 6/1997 | Rodgers, Jr. | 482/51 |
| 5,653,662 A | | 8/1997 | Rodgers, Jr. | 482/51 |
| 5,685,804 A | | 11/1997 | Whan-Tong et al. | 482/51 |
| 5,779,599 A | * | 7/1998 | Chen | 482/57 |
| 5,803,871 A | * | 9/1998 | Stearns et al. | 482/52 |
| 5,882,281 A | * | 3/1999 | Stearns et al. | 482/51 |
| 5,893,820 A | * | 4/1999 | Maresh et al. | 482/51 |
| 6,126,574 A | * | 10/2000 | Stearns et al. | 482/52 |
| 6,171,215 B1 | * | 1/2001 | Stearns et al. | 482/51 |

* cited by examiner

*Primary Examiner*—Stephen R. Crow

(57) ABSTRACT

Various exercise apparatus have respective linkage assemblies which are movably mounted on a frame and link rotation of left and right cranks to elliptical movement of left and right foot supporting members. The linkage assemblies include separate linkage arrangements for horizontal and vertical displacement of the foot supporting members, and the linkage assemblies accommodate travel of the foot supporting members to positions laterally adjacent the cranks.

7 Claims, 29 Drawing Sheets

Fig. 7
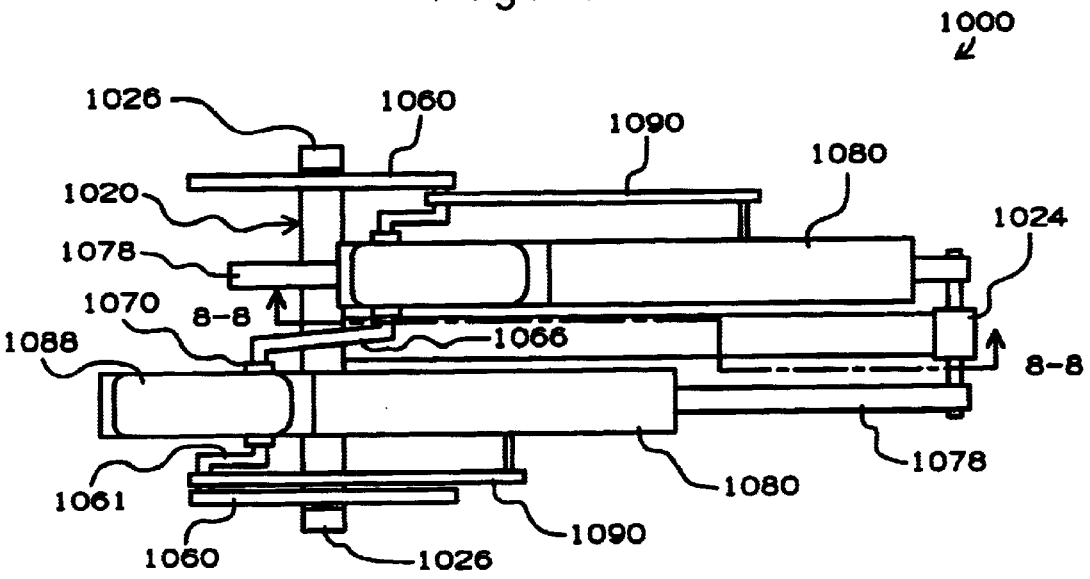
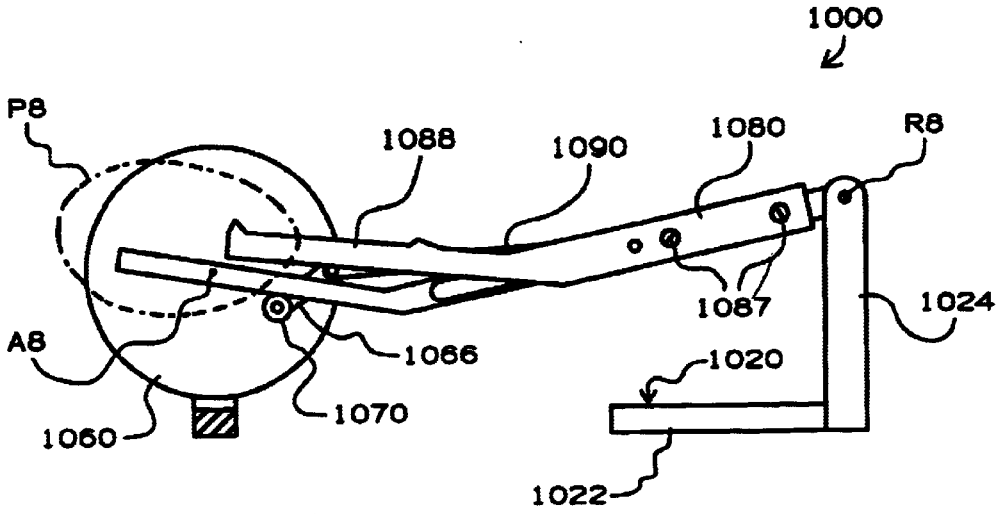
Fig. 8

ELLIPTICAL EXERCISE METHODS AND APPARATUS

CROSS-REFERENCE TO RELATED APPLICATIONS

This application is a continuation-in-part of U.S. patent application Ser. No. 09/072,765, filed on May 5, 1998 (now U.S. Pat. No. 6,171,215), which in turn, is a continuation-in-part of both U.S. patent application Ser. No. 08/839,990, filed on Apr. 24, 1997 (now U.S. Pat. No. 5,893,820), and U.S. patent application Ser. No. 09/064,393, filed on Apr. 22, 1998 (now U.S. pat. No. 5,882,281), the latter of which, in turn, is a continuation-in-part of U.S. patent application Ser. No. 08/839,991, filed on Apr. 24, 1997 (now U.S. Pat. No. 5,803,871). This application is also a continuation-in-part of U.S. patent Application Ser. No. 09/678,352, filed on Oct. 3, 2000, which is a continuation of U.S. patent Application Ser. No. 09/066,143, filed on Apr. 24, 1998 (U.S. Pat. No. 6,126,574), which in turn, is a continuation-in-part of U.S. patent Application Ser. No. 08/839,991, filed on Apr. 24, 1997 (U.S. Pat. No. 5,803,871). This application is also a continuation-in-part of U.S. patent application Ser. No. 09/510,029, filed on Feb. 22, 2000 (now U.S. Pat. No. 6,338,698), which in turn, is a continuation of U.S. patent application Ser. No. 09/064,368, filed on Apr. 22, 1998 (now U.S. Pat. No. 6,027,431), which in turn, is a continuation-in-part of U.S. patent application Ser. No. 08/949,508, filed on Oct. 14, 1997 (now abandoned). Finally, this application also discloses subject matter entitled to the earlier filing date of U.S. Provisional Application Ser. No. 60/148,304, filed on Aug. 11, 1999.

FIELD OF THE INVENTION

The present invention relates to exercise methods and apparatus and more particularly, to relatively compact exercise equipment which facilitates relatively favorable elliptical exercise motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically converts a relatively simple motion, such as circular, into a relatively more complex motion, such as elliptical.

U.S. Pat. No. 4,185,622 to Swenson discloses an exercise machine that generates elliptical exercise motion. Left and right foot supporting links have rearward ends which are rotatably coupled to respective cranks, and forward ends which are rotatably coupled to respective rocker links or guides. As a result, the rearward ends of the foot supporting links rotate in a circle together with the cranks; the forward ends of the foot supporting links move in reciprocal fashion together with the rocker links; and all intermediate points on the foot supporting links move through respective elliptical paths (which are similar in length but decrease in height as a function of distance from the crank axis). An advantage of this arrangement is that the heel of a user rises faster than his toe as the foot supporting link begins moving forward, and the heel of the user falls faster than the toe as the foot supporting link begins moving rearward.

U.S. Pat. No. 5,279,529 to Eschenbach also discloses an exercise machine that generates elliptical exercise motion. Left and right foot supporting links have rearward ends which are rotatably coupled to respective cranks, and forward ends which are rotatably coupled to respective rocker links on one embodiment (shown in FIG. 4 of the Eschenbach patent), and which are rotatably coupled to respective rollers on another embodiment (shown in FIG. 8 of the Eschenbach patent). As a result, the rearward ends of the foot supporting links rotate in a circle together with the cranks; the forward ends of the foot supporting links move in reciprocal fashion together with the rocker links or the rollers; and all intermediate points on the foot supporting links move through respective elliptical paths (which are similar in length but decrease in height as a function of distance from the crank axis). This arrangement similarly causes the heel of a user to rise faster than his toe as the foot supporting link begins moving forward, and the heel of the user to fall faster than the toe as the foot supporting link begins moving rearward.

Another feature of the machines shown in the Eschenbach patent is that the person's feet may be selectively moved to different positions along the foot supporting links. As a result, all portions of the user's feet may be positioned for movement through respective elliptical paths during rotation of the cranks. In other words, as compared to the Swenson machine, the person's feet may be positioned for movement through somewhat flatter elliptical paths on the Eschenbach machines.

U.S. Pat. No. 5,242,343 to Miller also discloses an exercise machine that generates elliptical exercise motion. Left and right foot supporting links have rearward ends which are rotatably coupled to respective cranks, and forward ends which are rotatably coupled to respective rocker links on one embodiment (shown in FIG. 4 of the Miller patent), and which are rotatably coupled to respective rollers on another embodiment (shown in FIG. 1 of the Miller patent). As a result, the rearward ends of the foot supporting links rotate in a circle together with the cranks; the forward ends of the foot supporting links move in reciprocal fashion together with the rocker links or the rollers; and all intermediate points on the foot supporting links move through respective elliptical paths (which are similar in length but decrease in height as a function of distance from the crank axis). This arrangement similarly causes the heel of a user to rise faster than his toe as the foot supporting link begins moving forward, and the heel of the user to fall faster than the toe as the foot supporting link begins moving rearward.

Another feature of the machines shown in the Miller patent is that the foot supporting platforms occupy relatively forward positions along the foot supporting links. As a result, all portions of the user's feet are positioned for movement through respective elliptical paths during rotation of the cranks. Moreover, as compared to the Eschenbach machine, the person's feet are positioned for movement through somewhat flatter elliptical paths on the Miller machines. It is somewhat problematic to describe or compare the respective locations of and/or paths traveled by a person's feet on the Miller machines and the Eschenbach machines because the analysis depends upon the size of a person's feet. What can be said with certainty is that the Miller machines simulate a relatively flatter striding motion because the foot platforms are positioned to remain entirely forward of the crank diameter at all times.

As compared to the Swenson machine, the Miller machines use a relatively larger crank diameter to generate a longer stride. In order to generate a comfortable amount of rise in relation to the stride length, the foot platforms must be spaced a significant distance forward of the crank axis (to "dilute" the vertical component of the striding motion).

Generally speaking, a common shortcoming of many prior art machines (including those discussed above) is that a common linkage arrangement generates both the horizontal component of foot travel and the vertical component of foot travel. As a result, any desired increase in the length of foot motion necessarily involves an increase in the height of foot motion, as well. Unfortunately, this fixed aspect ratio is contrary to real life activity, since a person does not typically lift his legs higher and higher while taking strides which are longer and longer.

As a result of the direct relationship between horizontal foot travel and vertical foot travel, undesirable compromises were made to arrive at the prior art machines discussed above. For example, the Swenson machine is relatively compact, but the user's heels travel through paths of motion which are nearly circular, and the user's toes travel through paths of motion which are nearly arcuate. At the other extreme, the Miller machines guide all portions of the user's feet through relatively flat elliptical paths of motion, but the machines are significantly longer than the Swenson machine. In fact, most prior art machines combine a relatively large crank diameter in order to generate a sufficiently long striding motion, and relatively long foot supports in order to reduce the associated vertical component of the striding motion (making the foot paths relatively flatter than they are long).

As suggested by the foregoing discussion, a need remains for a relatively compact elliptical motion exercise machine which generates a relatively long striding motion having a natural aspect ratio between stride length and stride height.

SUMMARY OF THE INVENTION

The present invention may be described in terms of linkage assemblies and corresponding exercise apparatus which link circular motion to relatively more complex, generally elliptical motion. More specifically, left and right cranks are rotatably mounted on a frame to provide rotating left and right connection points which define a crank diameter therebetween. Left and right foot supporting linkages are movably interconnected between the frame and respective connection points in such a manner that rotation of the cranks is linked to generally elliptical movement of left and right foot platforms. The linkages include foot supporting members which are connected, but not coupled, to respective connection points for purposes of determining vertical movement of a person's feet (as a function of the crank diameter). The linkages also include drawbar arrangements which determine horizontal movement of the person's feet (independent of the crank diameter). These "decoupled" foot platforms or dual drive assemblies facilitate increases in stride length and/or decreases in machine length.

On a preferred embodiment, the foot supporting members are positioned adjacent one another and between opposite side cranks, thereby accommodating movement of a person's feet between the cranks. This sort of arrangement allows for shorter machines without sacrificing stride length. At least one guard or shield may be provided between the foot platforms to eliminate pinch points and/or reduce the likelihood of the user's feet or ankles striking one another during exercise.

In another respect, the present invention may be described in terms of linkage assemblies and corresponding exercise apparatus which link reciprocal motion to relatively more complex, generally elliptical motion. For example, left and right handlebar links may be rotatably connected to the frame and linked to at least one link in the elliptical motion linkage assembly. As the foot supports move through their generally elliptical paths, the handlebars pivot back and forth relative to the frame. In order to accommodate the proximity of the foot platforms on the preferred embodiment, the frame may be provided with opposite side posts for supporting respective handlebar links therebetween.

In yet another respect, the present invention may be described in terms of linkage assemblies and corresponding exercise apparatus which independently generate the horizontal and vertical components of generally elliptical exercise motion. In this regard, the foot platforms are driven up and down by respective cranks, and forward and backward by respective drawbar arrangements which have a range of motion in excess of the crank diameter defined between the crank connection points. The effect of the drawbar arrangements may be amplified by means of rocker links which support the foot supporting members at a first, relatively greater distance from the rocker axis, and which support the drawbars at a second, relatively smaller distance from the rocker axis. Additional features and/or advantages of the present invention may become apparent from the more detailed description that follows.

BRIEF DESCRIPTION OF THE DRAWING

With reference to the FIGS. of the Drawing, wherein like numerals represent like parts and assemblies throughout the several views.

FIG. 7 is a top view of another embodiment of the present invention;

FIG. 8 is a partially sectioned side view of the exercise apparatus of FIG. 7, taken along the line 8—8;

DETAILED DESCRIPTION OF THE PREFERRED EMBODIMENT

Figure 1:
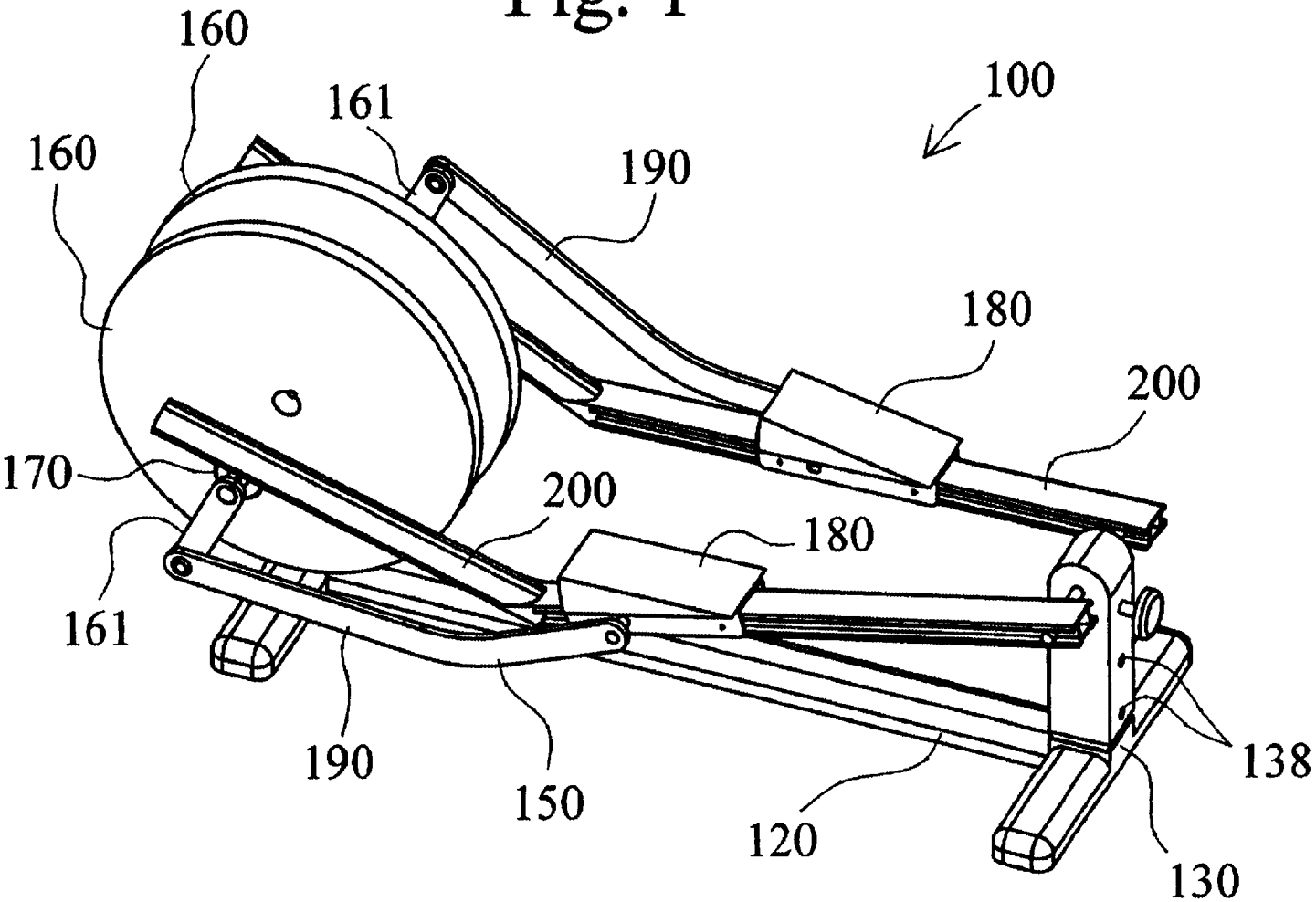
FIG. 1 is a perspective view of an exercise apparatus constructed according to the principles of the present invention.
Figure 2:
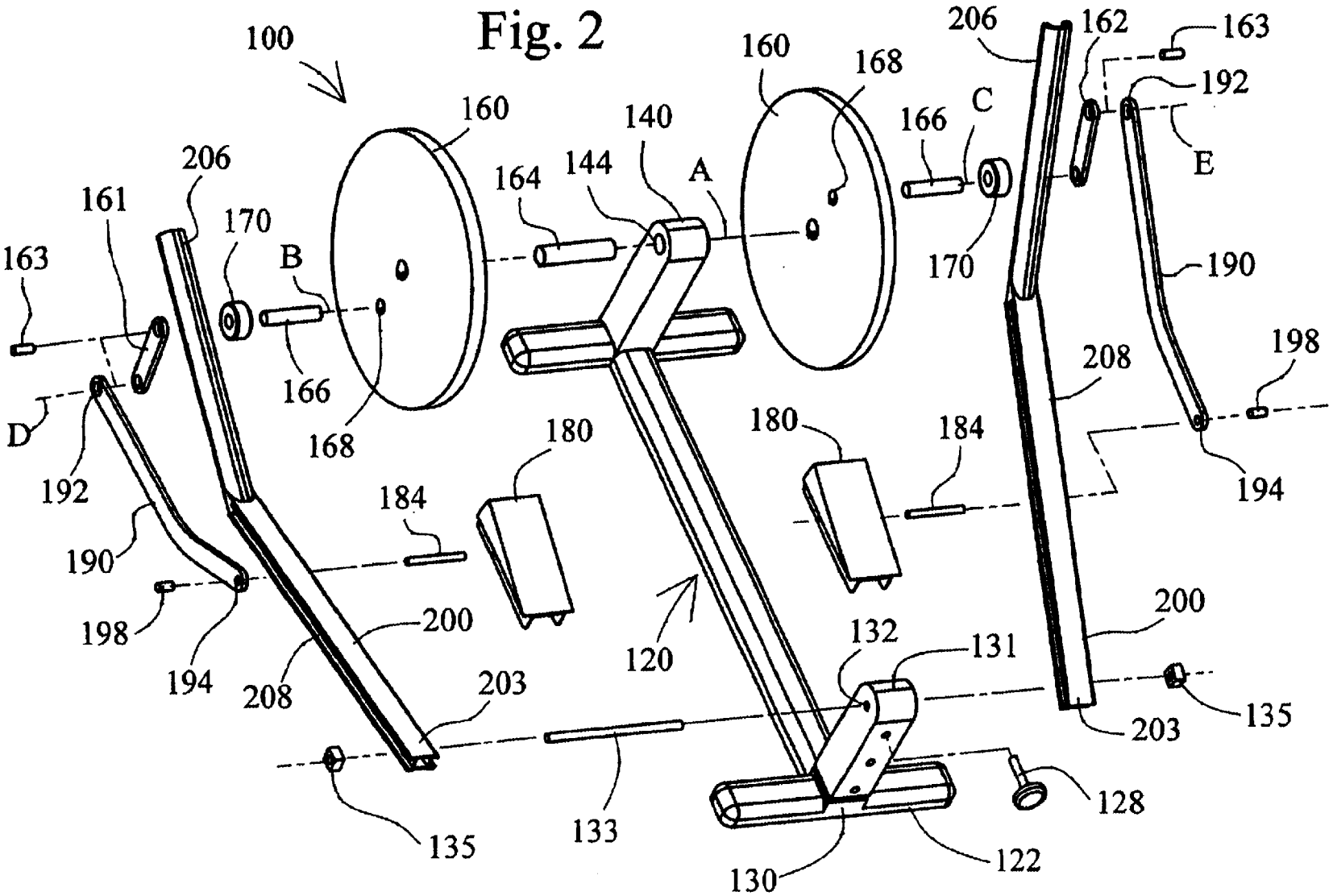
FIG. 2 is an exploded perspective view of the exercise apparatus of FIG. 1.
Figure 3:
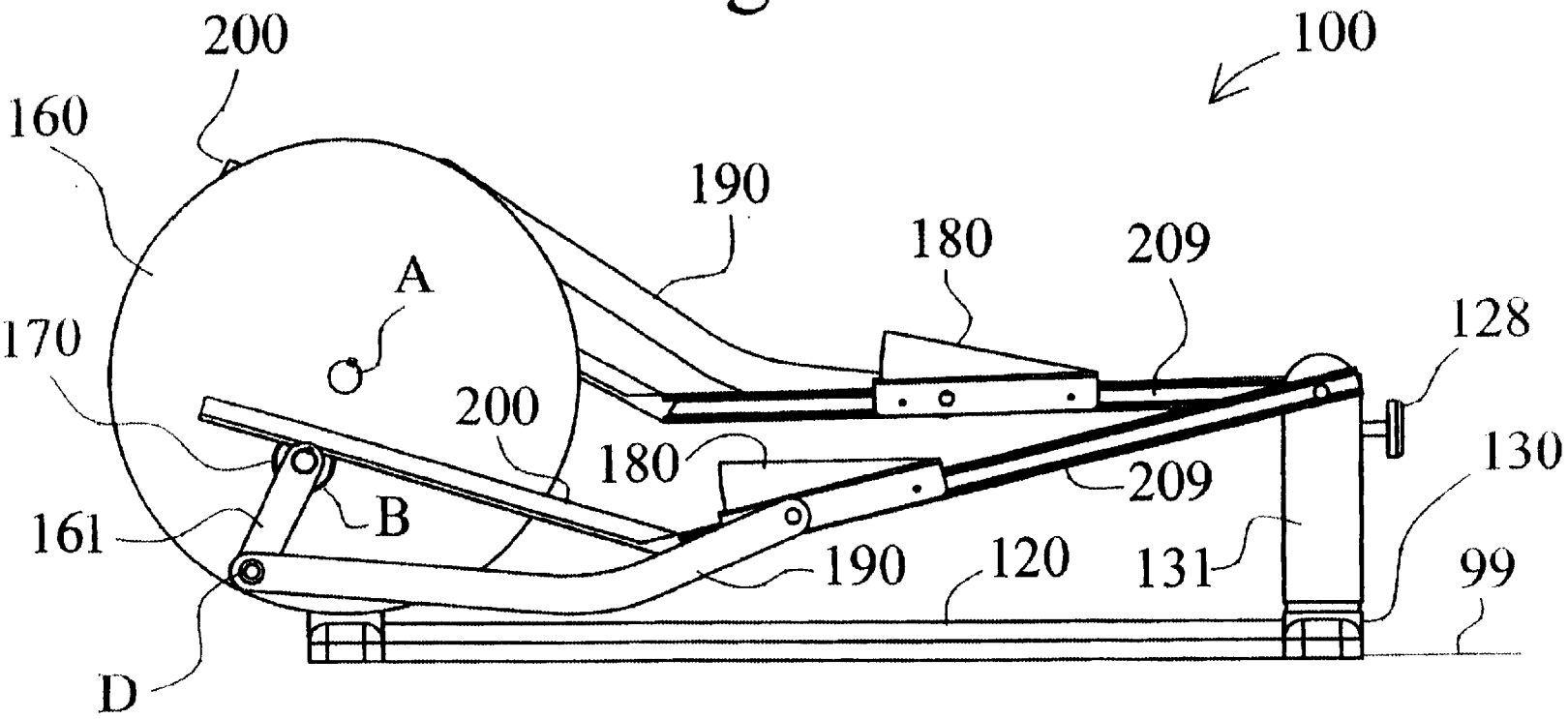
FIG. 3 is a side view of the exercise apparatus of FIG. 1.
Figure 4:
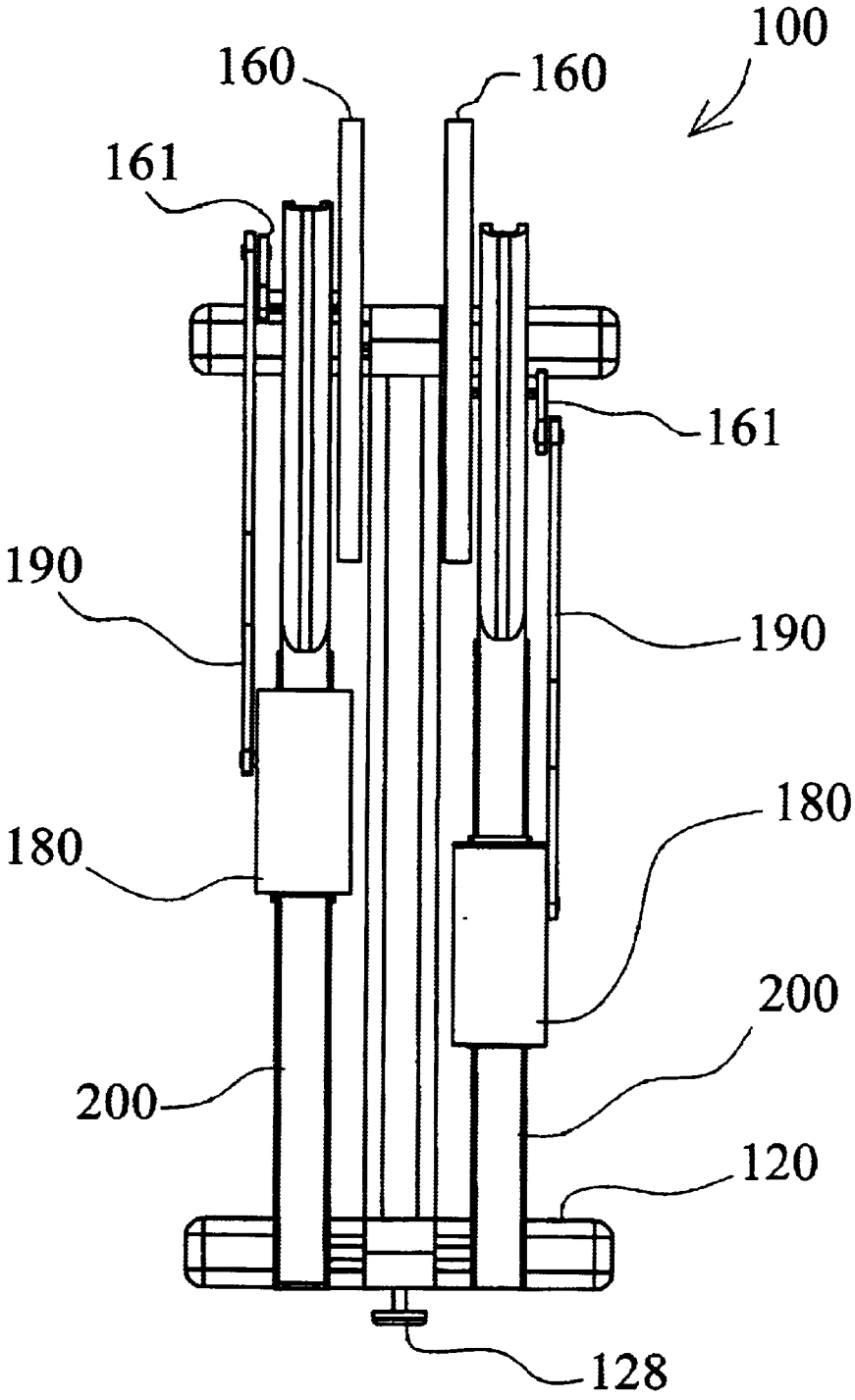
FIG. 4 is a top view of the exercise apparatus of FIG. 1.
Figure 5:
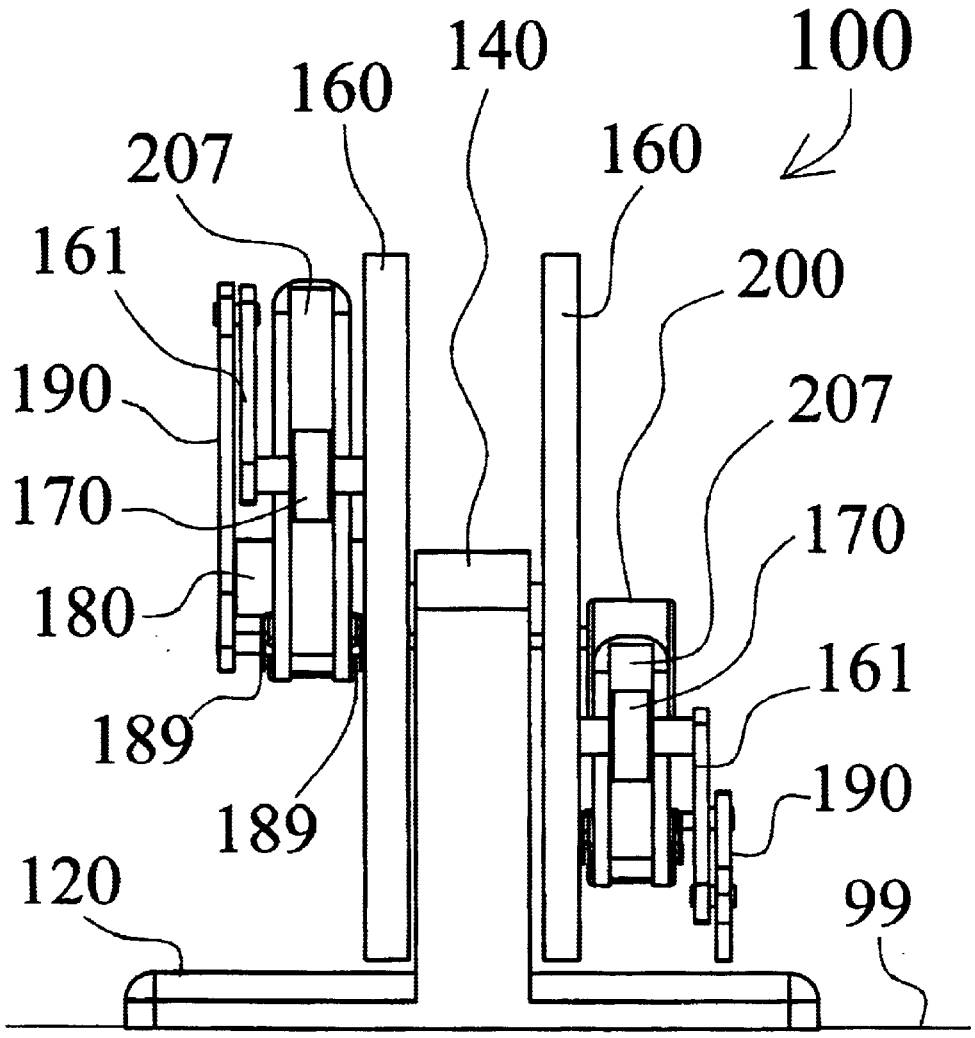
FIG. 5 is a rear view of the exercise apparatus of FIG. 1.

The present invention provides various elliptical motion exercise machines which link rotation of left and right cranks to generally elliptical motion of respective left and right foot supports. The term "elliptical motion" is intended in a broad sense to describe a closed path of motion having a relatively longer, major axis and a relatively shorter, minor axis (which extends perpendicular to the first axis). All of the above-identified "elliptical" patents are incorporated herein by reference.

In general, the machines may be said to use displacement of the cranks to move the foot supports in a direction coincidental with the minor axis, and displacement of crank driven members to move the foot supports in a direction coincidental with the major axis. A general characteristic of the present invention is that the crank diameter which determines the length of the minor axis does not also determine the length of the major axis. As a result of this characteristic, a person's feet may pass within a crank radius of the crank axis while nonetheless traveling through a generally elliptical path having a desirable aspect ratio, and the machines which embody this technology may be made relatively more compact, as well.

The embodiments shown and/or described herein are generally symmetrical about a vertical plane extending lengthwise through a floor-engaging base (perpendicular to the transverse ends thereof), the primary exception being the relative orientation of certain parts of the linkage assembly on opposite sides of the plane of symmetry. In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. The portions of the frame which are intersected by the plane of symmetry exist individually and thus, do not have any "opposite side" counterparts. Also, to the extent that reference is made to forward or rearward portions of an apparatus, it is to be understood that a person can typically exercise on such apparatus while facing in either direction relative to the linkage assembly.

Many of the disclosed embodiments may be modified by the addition and/or substitution of various known inertia altering devices, including, for example, a motor, a "stepped up" flywheel, or an adjustable brake of some sort. Moreover, although many of the rotationally interconnected components are shown to be pinned in cantilevered fashion relative to one another, many such components may be modified so that an end of a first component is retained between opposing prongs on the end of a second component. Furthermore, when a particular feature or suitable alternative is described with reference to a particular embodiment, it is to be understood that similar modifications may be implemented on other embodiments, as well.

With the foregoing in mind, several embodiments of the present invention will now be described in relatively greater detail, beginning with the exercise apparatus designated as 2000 in FIGS. 25–28. The machine 2000 generally includes a frame 2020 designed to rest upon a floor surface; left and right linkage assemblies movably mounted on the frame 2020; and a user interface 2025 mounted on the frame 2020. The interface 2025 may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The frame 2020 includes a floor engaging base 2022; a forward stanchion 2024 which extends upward from opposite sides of the base 2022, proximate the front end of the frame 2020; and rearward supports 2026 which extend upward from respective sides of the base 2022, proximate the rear end of the frame 2020. The forward stanchion 2024 may be described as an inverted U-shaped member having a middle portion or console 2002 which supports the user interface 2025, and generally vertical leg portions which define a gap therebetween. The console 2002 may also be configured to support other items, including a water bottle, for example.

Each linkage assembly includes a crank arm 2060 or a crank disc 2061 (one of each type of "crank" is shown on the machine 2000 to emphasize their interchangeability) rotatably mounted to a respective support 2026 and rotatable about a crank axis. The crank arm 2060 and the crank disc 2061 perform the same linkage function, although the crank disc 2061 has different inertial qualities and may be more readily connected to a stepped-up flywheel for purposes of altering the inertial and/or resistance characteristics associated with rotation of the crank disc 2061.

Left and right support shafts 2067 are rigidly secured to radially displaced portions of respective cranks 2060 and 2061, and thereby define respective orbiting and diametrically opposed axes. A central crank disc 2062 is rigidly interconnected between the inward ends of the diametrically opposed support shafts 2067, thereby linking the left and right linkage assemblies to move one hundred and eighty degrees out of phase with one another.

Each linkage assembly also includes a rail 2070 having a rearward end which is rotatably mounted on a respective support shaft 2067. An opposite, forward end of each rail 2070 is connected in telescoping fashion to a respective foot supporting member 2080. Rollers or bearings are preferably interconnected between the foot supporting members 2080 and respective rails 2070 to facilitate a smooth gliding interface therebetween. As a result of this telescoping arrangement, the foot supporting members 2080 are constrained to move vertically together with respective rails 2070, but remain free to move horizontally relative to respective rails 2070. In this regard, the telescoping arrangement effectively "de-couples" the foot supporting members 2080 from the horizontal displacement of the cranks 2060 and 2061.

A foot platform 2088 is mounted on the rearward end of each foot supporting member 2080, and an opposite, forward end of each foot supporting member 2080 is pivotally coupled to a lower portion of a respective guide or rocker link 2050. An opposite, upper portion of each rocker link 2050 is pivotally coupled to the frame member 2024. Upwardly extending handlebars may be movably mounted on the frame 2020 and/or directly or indirectly connected to respective rocker links 2050 to facilitate upper body exercise motion along with the lower body exercise motion.

Each linkage assembly further includes a drawbar 2090 having a rear end pivotally coupled to a respective crank 2060 or 2061, and a forward end pivotally connected to an intermediate portion of a respective rocker link 2050. Each drawbar 2090 links rotation of a respective crank 2060 or 2061 to back and forth pivoting of a respective rocker link 2050. The "pivot arm" or radius associated with each drawbar 2090 is shorter than the "pivot arm" or radius associated with each foot supporting link 2080, and thus, the foot supporting links 2080 pivot fore and aft to a greater extent than the drawbars 2090. The extent of this "amplification effect" may be adjusted by securing the drawbars 2090 in alternative locations 2059 along the,rocker links 2050.

Figure 27:
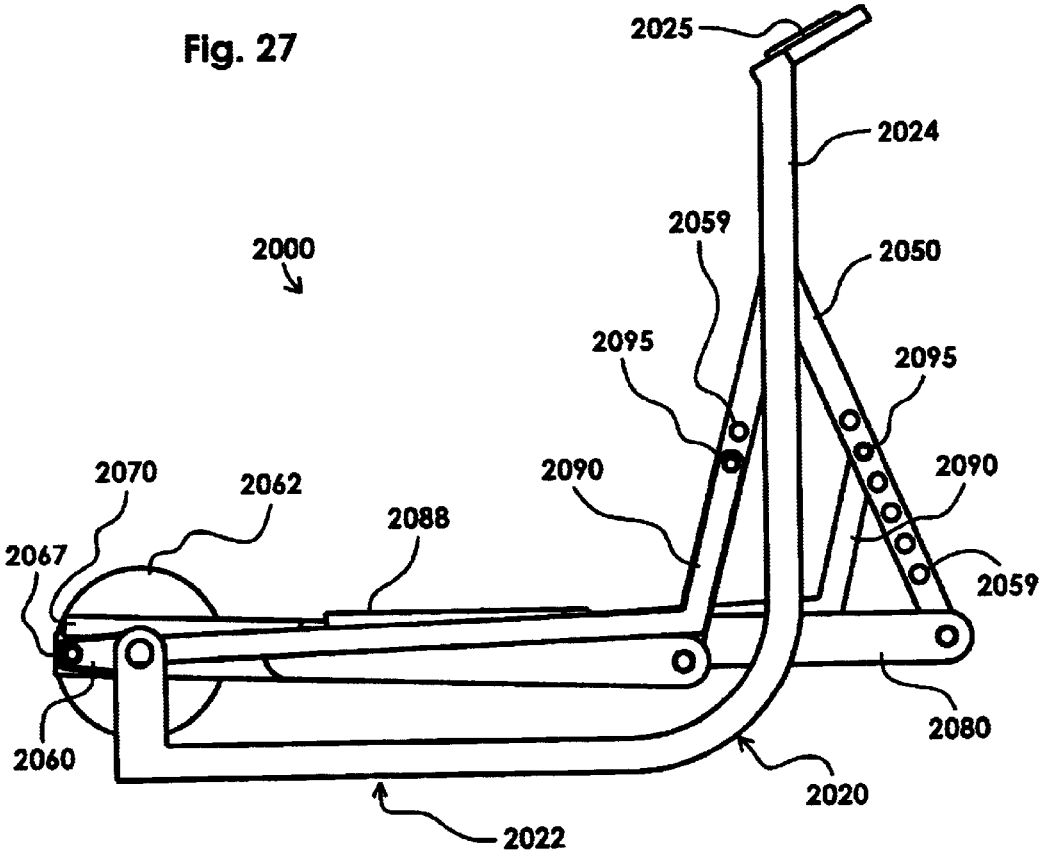
FIG. 27 is a right side view of the exercise apparatus of FIG. 25 with the right side crank at a 9:00 orientation.
Figure 28:
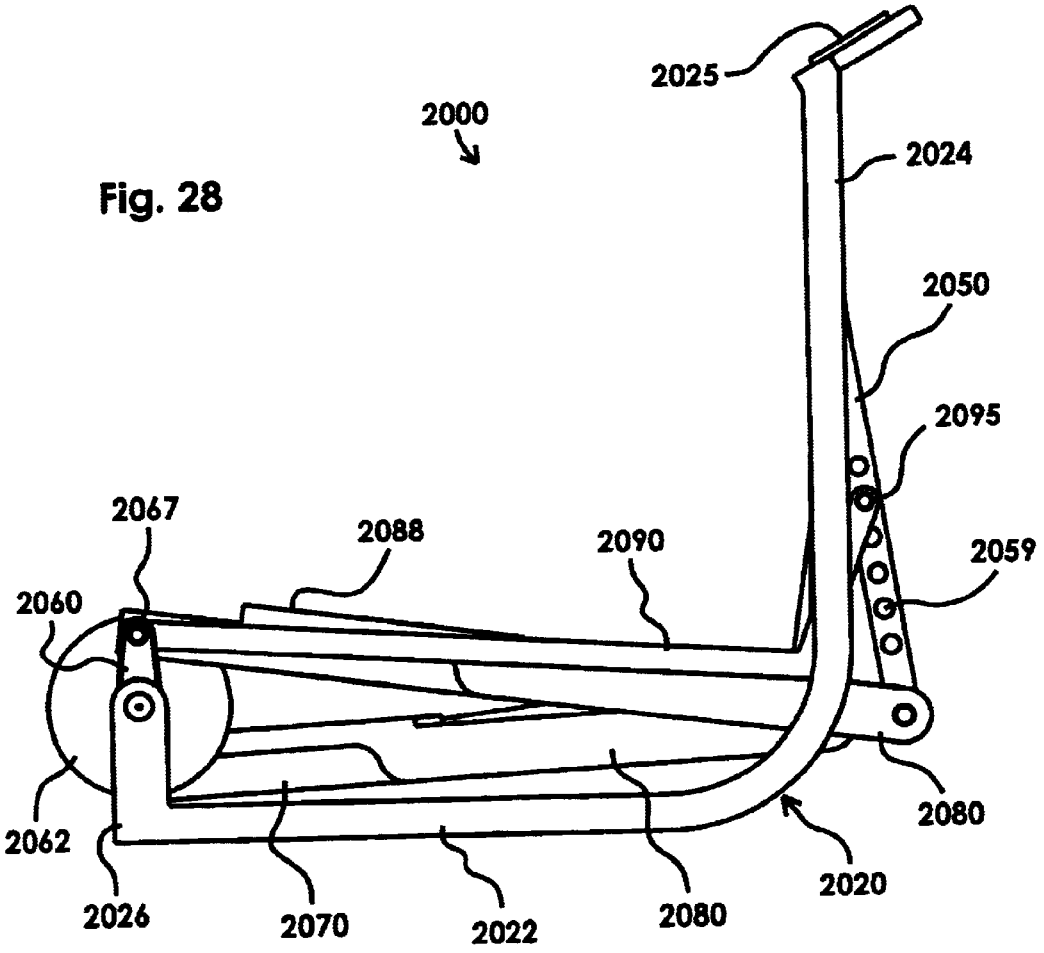
FIG. 28 is a right side view of the exercise apparatus of FIG. 25 with the right side crank at a 12:00 orientation.

FIG. 27 shows the advantageous relationship between stride length and machine size which can be realized on the machine 2000. For example, the machine 2000 may be approximately fifty-two inches long and have a crank diameter of approximately twelve inches and yet, be capable of generating approximately twenty inches in stride length. FIG. 28 shows the advantageous relationship between stride length and stride height which can be realized on the same machine. 2000 (the stride height cannot exceed the twelve inch diameter of the cranks 2060 and 2061). Generally speaking, the prior art designs described above would require almost twice the crank diameter and twice the machine length in order to provide a comparable striding motion.

One reason for the relatively compact size of the machine 2000 is that the foot platforms 2088 are movable into the space adjacent and/or above the cranks 2060 and 2061. As suggested by the accompanying figures, this spatial relationship (between the foot platforms 2088 and the cranks 2060 and 2061) may be implemented and/or described in various ways, including: the foot platforms 2088 are movable rearward beyond a vertical plane which extends tangent to the circular path defined by the cranks 2060 and 2061; the foot platforms 2088 are movable to respective positions within a crank radius of the crank axis; the foot platforms 2088 are movable rearward of a vertical plane extending through the crank axis; and/or the foot platforms 2088 are movable through respective paths about the crank axis. In each of these scenarios, the machine 2000 may be made relatively shorter than the prior art machines without sacrificing stride length and/or a desirable aspect ratio between stride length and stride height.

Another desirable feature of the machine 2000 is that the foot platforms 2088 are positioned in close proximity to one another, thereby accommodating foot motion which better approximates real life activity. In this regard, the opposite side cranks 2060 and 2061 and central support crank 2062 eliminate the need for a frame supported bearing assembly between the foot platforms 2088 and/or the cranks 2060 and 2061.

Figure 29:
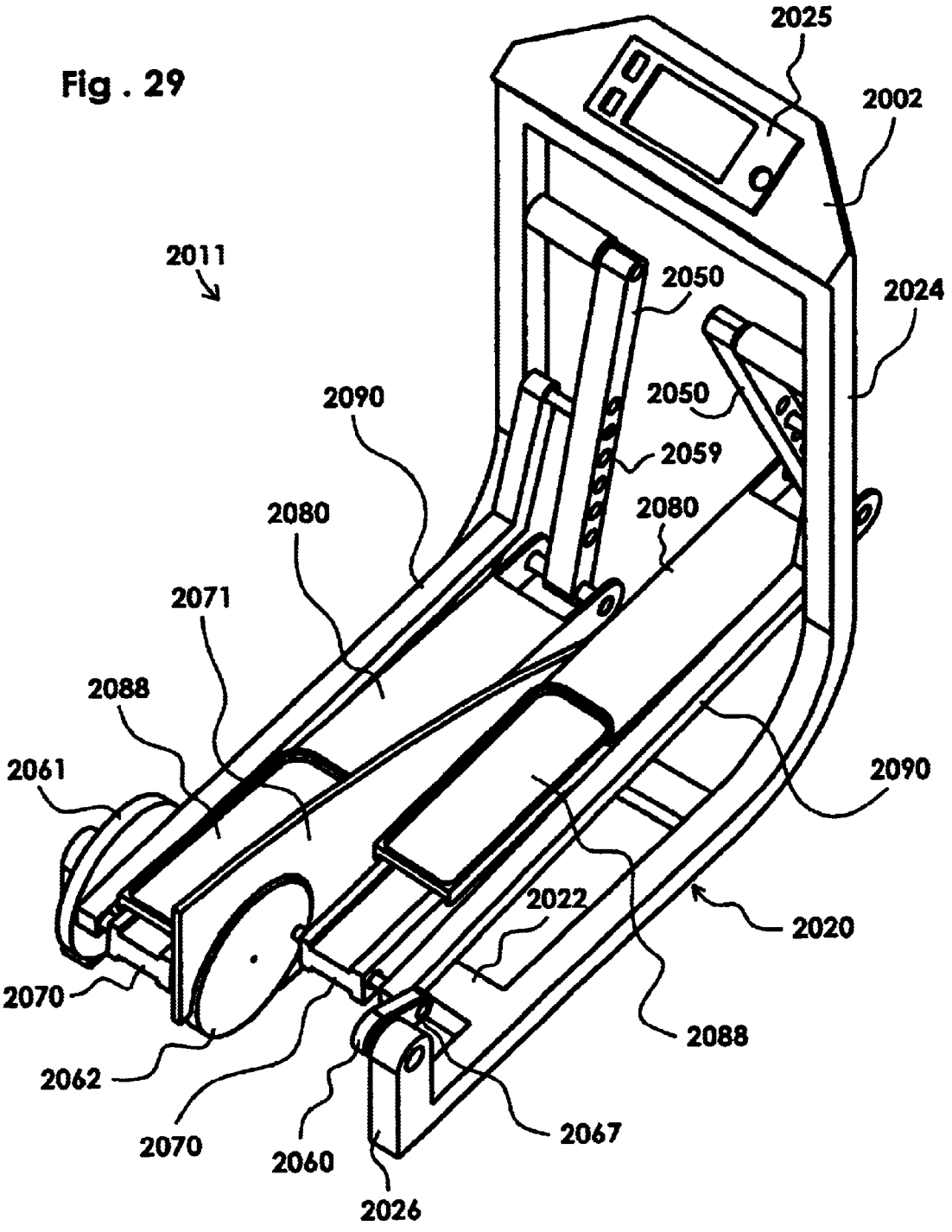
FIG. 29 is a perspective view of the exercise apparatus of FIG. 25 with a central shield having been added to the frame.
Figure 30:
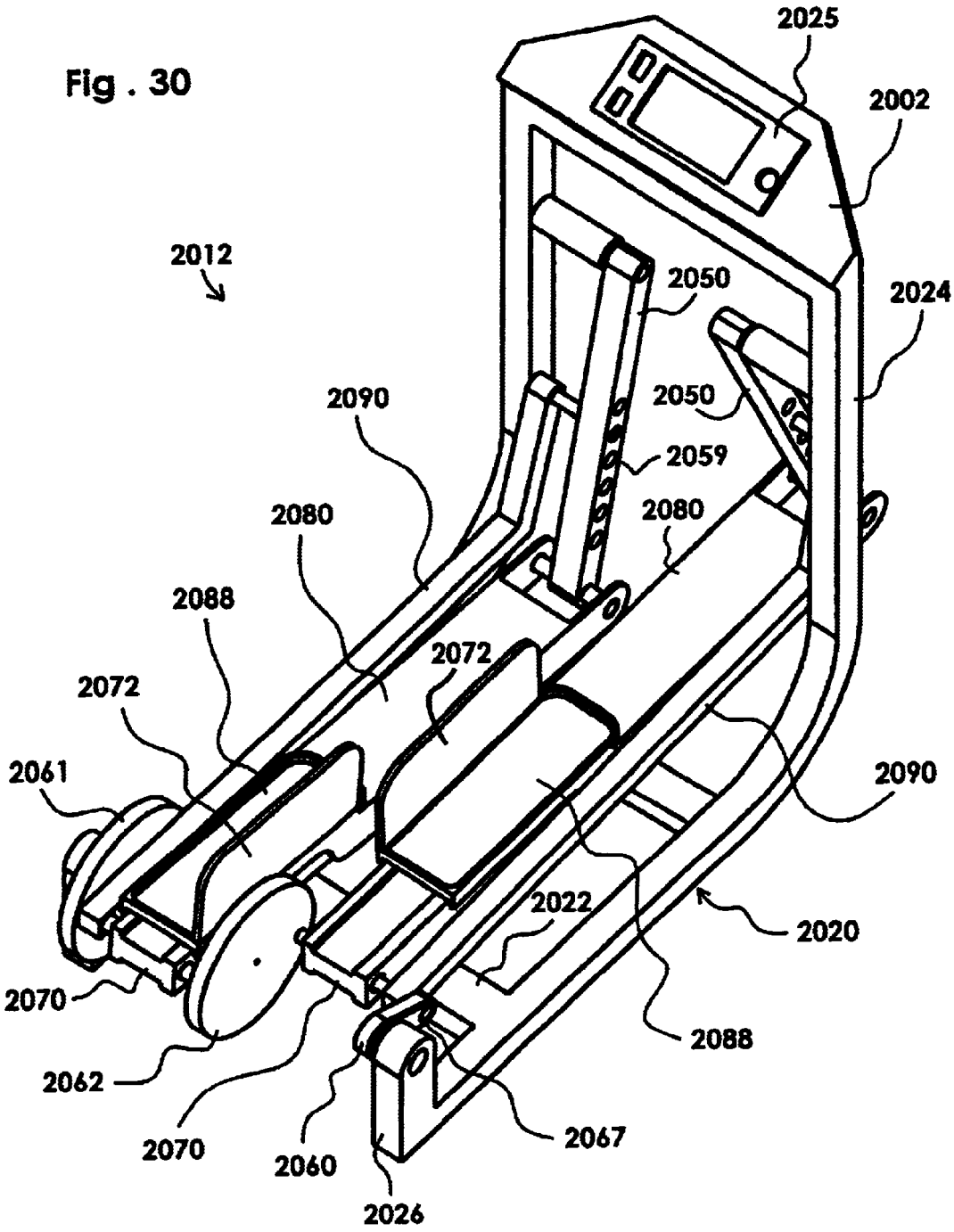
FIG. 30 is a perspective view of the exercise apparatus of FIG. 25 with left and right shields having been added to respective foot platforms.

In the absence of a centrally located bearing assembly, one or more shields or guards may be disposed between the opposing rails 2070 and foot engaging members 2080 in order to eliminate pinch points. For example, FIG. 29 shows a machine 2011 which is identical to the machine 2000 except that the frame has been modified to include a stationary shield 2071 disposed between the left and right foot supporting members 2080. An alternative arrangement is shown in FIG. 30, wherein a machine 2012 is identical to the machine 2000 except that a respective shield 2072 has been affixed to the inward side of each foot support 2088. Yet another suitable arrangement involves a central shield which is disposed between the foot supporting members, movably connected to the frame, and alternatively engaged by the higher of the two foot supporting members 2080.

Another exercise apparatus constructed according to the principles of the present invention is designated as 100 in FIGS. 1–5. The apparatus 100 generally includes a frame 120 and left and right linkage assemblies movably mounted on the frame 120. Generally speaking, the linkage assemblies 150 link rotation of left and right flywheels 160 to generally elliptical motion of respective left and right force receiving members 180.

The frame 120 includes a base 122, a forward stanchion 130, and a rearward stanchion 140. The base 122 may be described as generally I-shaped and is designed to rest upon a generally horizontal floor surface 99 (see FIGS. 3 and 5). The forward stanchion 130 extends perpendicularly upward from the base 122 and supports a telescoping tube 131. A plurality of holes 138 are provided in the tube 131, and a single, similarly sized hole is provided in the upper end of the stanchion 130 to selectively align with any one of the holes 138. A pin 128, provided with a ball detent, is inserted through an aligned set of holes to secure the tube 131 in place relative to the stanchion 130. A laterally extending hole 132 extends through the tube 131 to support a shaft 133.

The rearward stanchion 140 extends perpendicularly upward from the base 122 and supports a bearing assembly. An axle 164 is inserted through a laterally extending hole 144 in the bearing assembly to support the flywheels 160 in a manner known in the art. For example, the axle 164 may be inserted through the hole 144, and then a flywheel 160 may be keyed to each of the protruding ends of the axle 164, on opposite sides of the stanchion 140. Those skilled in the art will recognize that the flywheels 160 may be replaced by some other rotating member(s) which may or may not, in turn, be connected to one or more flywheels. These rotating members 160 rotate about an axis designated as A.

Radially displaced shafts 166 are rigidly secured to respective flywheels 160 by means known in the art. For example, each shaft 166 may be inserted into a hole 168 in a respective flywheel 160 and welded in place. The shafts 166 are secured to respective flywheels 160 at diametrically opposed points which are radially displaced from the axis A. As a result, each shaft 166 rotates at a fixed radius about the axis A. In other words, the shafts 166 and the flywheels 160 cooperate to define left and right first cranks having a common first crank radius.

Rollers 170 are rotatably mounted on respective shafts 166. The roller 170 on the right side of the apparatus 100 rotates about an axis B, and the roller 170 on the left side of the apparatus 100 rotates about a diametrically opposed axis C. Rigid members or crank arms 161 are fixedly secured to respective shafts 166 by means known in the art. For example, each shaft 166 may be inserted into a hole in a respective rigid member 161 and then keyed in place. Each roller 170 is retained on a respective shaft 166 between the flywheel 160 and the rigid member 161.

Each rigid member 161 extends from the shaft 166 to a distal end 162 which occupies a position radially displaced from the axis A and rotates at a fixed radius about the axis A. In other words, the distal ends 162 and the flywheels 160, together with the parts interconnected therebetween, cooperate to define left and right second cranks, which have an effective crank radius that is longer than the left and right first cranks. On each side of the apparatus 100, the first crank and the second crank are portions of a single unitary member which is connected to the flywheel 160 by shaft 166, and they share a common rotational axis A.

On each side of the apparatus 100, a link or drawbar 190 has a rearward end 192 rotatably connected to the distal end 162 of the member 161 by means known in the art. For example, holes may be formed through the distal end 162 and the rearward end 192, and a rivet-like fastener 163 may inserted through the holes.and secured therebetween. As a result of this arrangement, the link 190 on the right side of the apparatus 100 rotates about an axis D relative to the right distal end 162 and the right flywheel 160; and the link 190 on the left side of the apparatus 100 rotates about a diametrically opposed axis E relative to the left distal end 162 and the left flywheel 160. On the apparatus 100, the axes A, B, and D may be said to be radially aligned, and the axes A, C, and E may be said to be radially aligned.

Each link 190 has a forward end 194 rotatably connected to a respective force receiving member 180 by means known in the art. For example, a pin 184 may be secured to the force receiving member 180, and a hole may be formed through the forward end 194 of the link 190 to receive the pin 184. A nut 198 may then be threaded onto the distal end of the pin 184. As a result of this arrangement, the link 190 may be said to be rotatably interconnected between the flywheel 160 and the force receiving member 180, and/or to provide a discrete means for interconnecting the flywheel 160 and the force receiving member 180.

Each force receiving member 180 is rollably mounted on a respective rail or track 200 and thus, may be described as a skate or truck. Each force receiving member 180 provides an upwardly facing support surface 188 sized and configured to support a person's foot.

Each rail 200 has a forward end 203, a rearward end 206, and an intermediate portion 208. The forward end 203 of each rail 200 is movably connected to the frame 120, forward of the flywheels 160. In particular, each forward end 203 is rotatably connected to the forward stanchion 130 by means known in the art. For example, the shaft 133 is inserted into the hole 132 through the tube 131 and into holes through the forward ends 203 of the rails 200. The shaft 133 may be keyed in place relative to the stanchion 130, and nuts 135 may be secured to opposite ends of the shaft 133 to retain the forward ends 203 on the shaft 133. As a result, the rail 200 may be said to provide a discrete means for movably interconnecting the force receiving member 180 and the frame 120.

The rearward end 206 of the rail 200 is supported or carried by the roller 170. In particular, the rearward end 206 may be generally described as having an inverted U-shaped profile into which an upper portion of the roller 170 protrudes. The "base" of the inverted U-shaped profile is defined by a flat bearing surface 207 which bears against or rides on the cylindrical surface of the roller 170. Those skilled in the art will recognize that other structures (e.g. studs and low friction bearing surfaces) could be substituted for the rollers 170. In any case, the rails 200 may be said to provide a discrete means for movably interconnecting the flywheels 160 and the force receiving members 180.

The intermediate portion 208 of the rail 200 may be defined as that portion of the rail 200 along which the skate 180 may travel and/or as that portion of the rail 200 between the rearward end 206 (which rolls over the roller 170) and the forward end 203 (which is rotatably mounted to the frame 120). The intermediate portion 208 may be generally described as having an I-shaped profile or as having a pair of C-shaped channels which open away from one another. Each channel 209 functions as a race or guide for one or more rollers 189 rotatably mounted on each side of the foot skate 180. Those skilled in the art will recognize that other structures (e.g. linear bearings) could be substituted for the rollers 189.

On the apparatus 100, both the end portion 206 and the intermediate portion 208 of the support member 200 are linear. However, either or both may be configured as a curve without departing from the scope of the present invention. Moreover, although the end portion 206 is fixed relative to the intermediate portion 208, a provision for orientation adjustment is also within the scope of the present invention.

Those skilled in the art will also recognize that each of the components of the linkage assembly 150 is necessarily long enough to facilitate the depicted interconnections. For example, the members 161 and the links 190 must be long enough to interconnect the flywheel 160 and the force receiving member 180 and accommodate a particular crank radius. Furthermore, for ease of reference in both this detailed description and the claims set forth below, linkage components are sometimes described with reference to "ends" being connected to other parts. For example, the link 190 may be said to have a first end rotatably connected to the member 161 and a second end rotatably connected to the force receiving member 180. However, those skilled in the art will recognize that the present invention is not limited to links which terminate immediately beyond their points of connection with other parts. In other words, the term "end" should be interpreted broadly, in a manner that could include "rearward portion", for example; and in a manner wherein "rear end" could simply mean "behind an intermediate portion", for example.

In operation, rotation of the flywheels 160 causes the shafts 166 to revolve about the axis A, thereby pivoting the rails 200 up and down relative to the frame 120, through a range of motion which is less than or equal to twice the radial distance between the axis A and either axis B or C (the first crank diameter). Rotation of the flywheels 160 also causes the distal ends 162 of the members 161 to revolve about the axis A, thereby moving the force receiving members 180 back and forth along the rails 200, through a range of motion which is approximately equal to twice the radial distance between the axis A and either axis D or E (the second crank diameter). This generally horizontal range of motion associated with the second crank diameter is greater than the generally vertical range of motion associated with the first crank diameter. In this regard, the present invention facilitates movement of a force receiving member through a path having a horizontal component which is not necessarily related to or limited by the vertical component and/or the crank diameter. As a result, it is a relatively simple matter to design an apparatus with a desired "aspect ratio" for the elliptical path to be traveled by the foot platform. For example, movement of the axes D and E farther from the axis A and/or movement of the axes B and C closer to the axis A will result in a relatively flatter path. Ultimately, the exact size, configuration, and arrangement of the linkage assembly components are a matter of design choice.

In relatively more general terms, the foregoing machine is one of many embodiments of the present invention which may be described in terms of an exercise apparatus, comprising: a frame designed to rest upon a floor surface; left and right cranks mounted on opposite sides of said frame and rotatable relative thereto about a common crank axis; and left and right linkage assemblies disposed on opposite sides of said frame and including: respective first portions connected to respective cranks at diametrically opposed locations relative to said crank axis, and thereby defining a crank diameter between said locations; respective second portions movably connected to said frame at an end opposite said cranks; and respective foot supports interconnected between respective first portions and respective second portions and movable relative to said frame through a distance greater than said crank diameter.

Some of the embodiments of the present invention may alternatively be described in terms of an exercise apparatus, comprising: a frame designed to rest upon a floor surface; left and right cranks rotatably mounted on said frame; left and right rails having first ends supported by respective cranks and second ends supported by said frame; and left and right foot supports movably mounted on respective rails and connected to respective cranks in such a manner that rotation of said cranks causes each of said foot supports to move vertically together with a respective rail and horizontally relative to a respective rail.

The present invention may be described in terms of methods, as well. For example, the present invention provides a method of linking rotation of left and right cranks to generally elliptical motion of left and right foot supporting members, comprising the steps of: providing a frame sized and configured to support a person relative to an underlying floor surface; rotatably mounting the left and right cranks on the frame; movably interconnecting left and right rails between the frame and respective cranks; and movably mounting left and right foot supports on respective rails and connecting the foot supports to respective cranks in such a manner that rotation of the cranks causes each of the foot supports to move vertically together with a respective rail and horizontally relative to a respective rail.

Figure 6A:
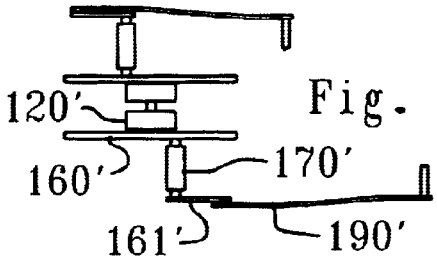
FIG. 6A is a top view of part of the linkage assembly on the exercise apparatus of FIG. 1.
Figure 6B:
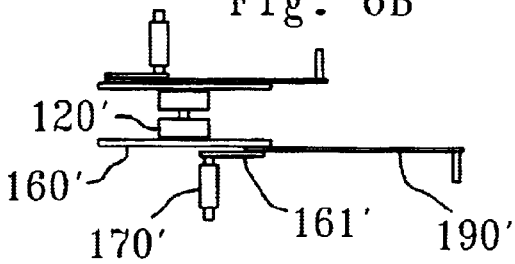
FIG. 6B is a top view of a linkage assembly similar to that of FIG. 6A, showing a second, discrete arrangement of the linkage assembly components.
Figure 6C:
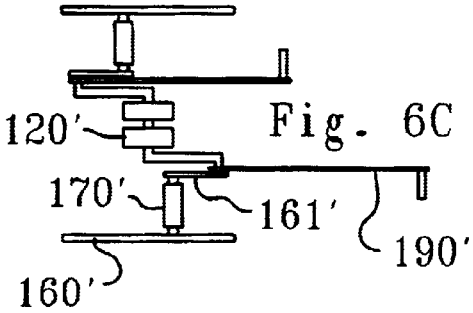
FIG. 6C is a top view of a linkage assembly similar to that of FIG. 6A, showing a third, discrete arrangement of the linkage assembly components.
Figure 6D:
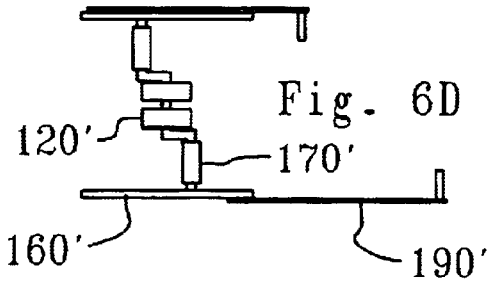
FIG. 6D is a top view of a linkage assembly similar to that of FIG. 6A, showing a fourth, discrete arrangement of the linkage assembly components.
Figure 6E:
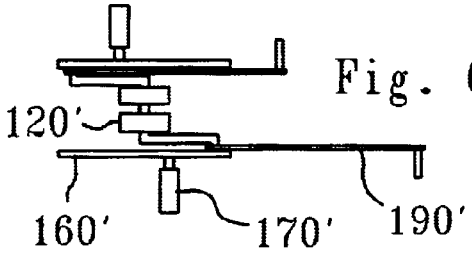
FIG. 6E is a top view of a linkage assembly similar to that of FIG. 6A, showing a fifth, discrete arrangement of the linkage assembly components.
Figure 6F:
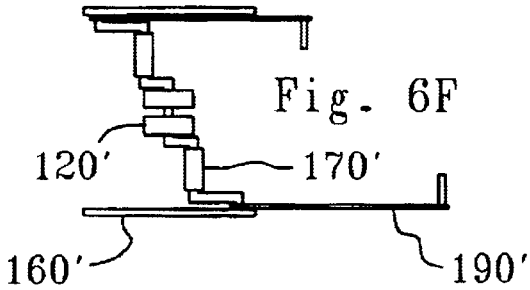
FIG. 6F is a top view of a linkage assembly similar to that of FIG. 6A, showing a sixth, discrete arrangement of the linkage assembly components.
Figure 6G:
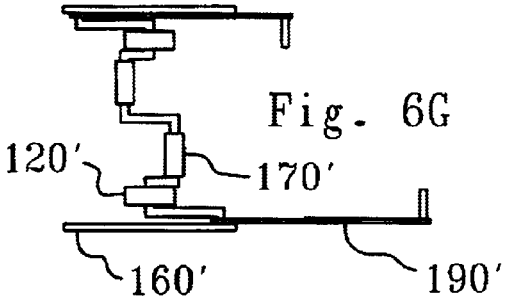
FIG. 6G is a top view of a linkage assembly similar to that of FIG. 6A, showing a seventh, discrete arrangement of the linkage assembly components.
Figure 6H:
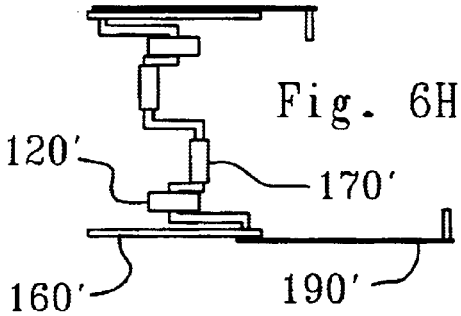
FIG. 6H is a top view of a linkage assembly similar to that of FIG. 6A, showing an eighth, discrete arrangement of the linkage assembly components.
Figure 6I:
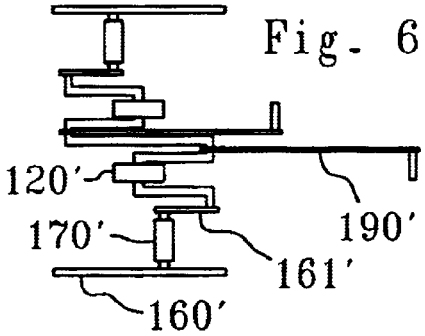
FIG. 6I is a top view of a linkage assembly similar to that of FIG. 6A, showing a ninth, discrete arrangement of the linkage assembly components.
Figure 6J:
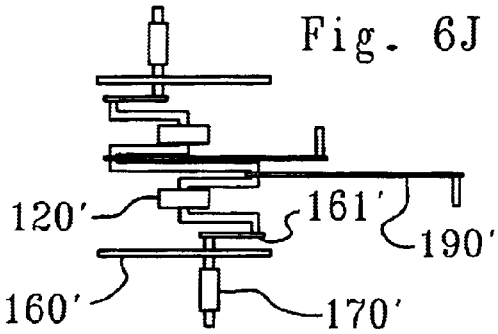
FIG. 6J is a top view of a linkage assembly similar to that of FIG. 6A, showing a tenth, discrete arrangement of the linkage assembly components.

Those skilled in the art will also recognize that the components of the foregoing embodiment 100 may be arranged in a variety of ways. For example, in each of FIGS. 6A–6J, flywheels 160', support rollers 170', members 161', and links 190' are shown in several alternative configurations relative to one another and the frame 120' (in some embodiments, there is no need for a discrete part 161' because both the links 190' and the rollers 170' are connected directly to the flywheels 160'). FIGS. 6G and 6H show arrangements wherein the foot supports are disposed adjacent one another, between outboard left and right cranks and the associated frame members.

An "outboard crank" type machine 1000 having a linkage arrangement similar to those of FIGS. 6G and 6H is shown in greater detail in FIGS. 7–8. The machine 1000 similarly includes a frame 1020 having a base 1022 designed to rest upon a floor surface. A forward stanchion 1024 extends upward from the base 1022 proximate its forward end, and left and right rearward stanchions 1026 extend upward from the base 1022 proximate its rearward end. Left and right cranks 1060 (depicted as discs) are rotatably mounted to respective stanchions 1026. A crank shaft 1066 is rigidly interconnected between the opposite side cranks 1060. As a result of this arrangement, the crank shaft 1066 and the cranks 1060 are constrained to rotate together about a common crank axis A8 relative to the frame 1020.

The crank shaft 1066 includes first axially extending portions, proximate each of the crank discs 1060, which define a relatively larger crank diameter, and second axially extending portions, proximate a central portion of the crank shaft 1066, which define a relatively smaller crank diameter. Left and right rollers 1070 are rotatably mounted on respective second portions of the crank shaft 1066 to support respective rearward portions of left and right rails 1078 in "de-coupled" fashion relative to respective cranks 1060. Opposite, forward ends of the rails 1078 are pivotally coupled to the forward stanchion 1024. As a result of this arrangement, the rails 1078 are constrained to pivot up and down about a common pivot axis R8 relative to the frame 1020.

Left and right foot supporting members 1080 are rollably mounted on respective rails 1078 by means of respective rollers (at locations designated as 1087). A foot platform 1088 is provided on each of the foot supporting members 1080 to support a respective foot of a standing person. On the machine 1000, the foot platforms 1088 are relatively rearward, and the rollers are relatively forward on the foot supporting members 1080, but the present invention is not limited in this regard. In any event, the foot platforms 1088 are constrained to move up and down together with the rails 1078, but are free to move back and forth relative to the rails 1078.

Left and right drawbars 1090 are pivotally coupled between respective foot supporting members 1080 and respective first portions of the crank shaft 1066. The drawbars 1090 link rotation of the cranks 1060 to back and forth movement of the foot supporting members 1080 along the rails 1078. Since the drawbars 1090 are driven through a larger crank diameter than the rollers 1070, the foot platforms 1088 move back and forth a greater amount than they move up and down, thereby establishing a generally elliptical path of motion. For example, FIG. 8 shows a path P8 which is traversed by a point on the upper surface of the foot platform 1088 which is intersected by the path P8. This path may be described as (a) encompassing the crank axis A8; (b) intersecting a cylinder of space defined between the crank discs 1060; (c) at least partially rearward of a vertical plane extending tangent to the forwardmost edges of the crank discs 1060; and/or (d) at least partially rearward of a vertical plane extending tangent to the rearwardmost edges of the crank discs 1060.

Figure 9:
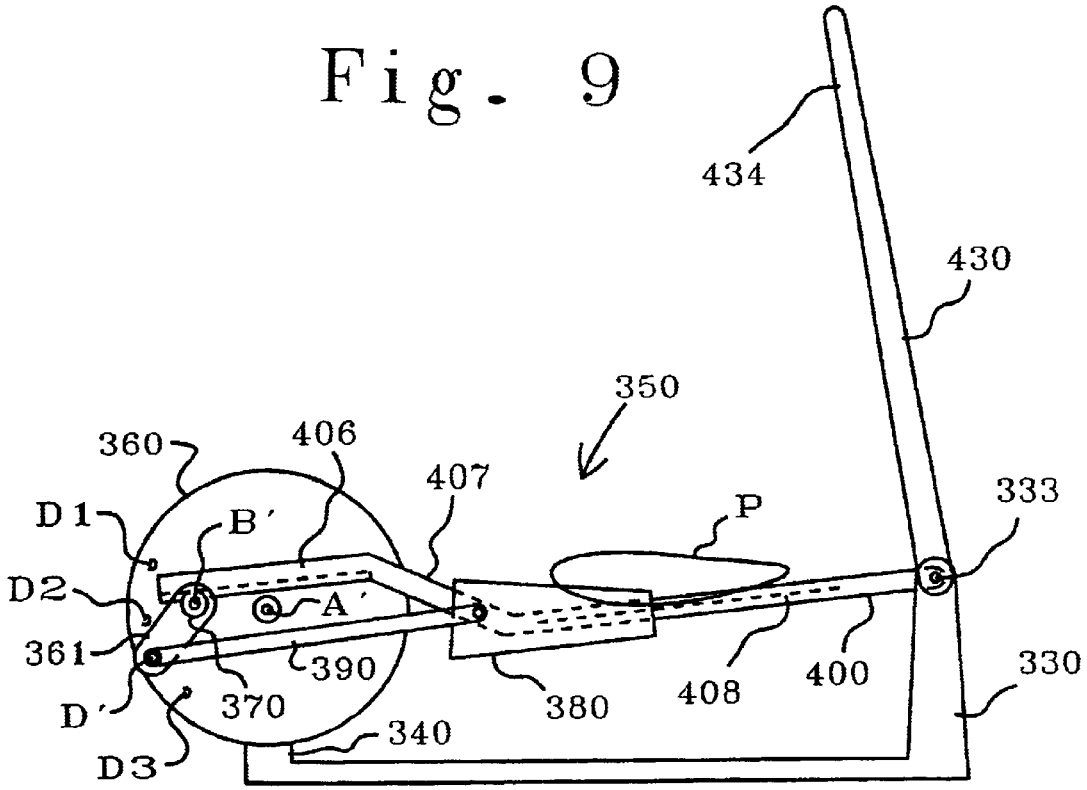
FIG. 9 is a side view of another embodiment of the present invention.

The spatial relationships, including the radii and angular displacement of the crank axes, may vary for different sizes, configurations, and arrangements of the linkage assembly components on the machine 1000 and/or the machine 100. For example, another embodiment of the present invention is shown in FIG. 9. The exercise apparatus 300 includes left and right linkage assemblies 350 which are movably mounted on a frame 320 and include left and right handle members 430. For ease of illustration and discussion, only the right side of the machine 300 is shown and described.

Like on the apparatus 100, a flywheel 360 is rotatably connected to a rearward stanchion 340 on the frame 320 and rotates about an axis A'. A roller 370 is rotatably connected to the flywheel 360 and rotates about an axis B' which is radially offset from the axis A'. A rigid member 361 has a first end which is connected to the flywheel 360 proximate axis B', and a second end which is radially offset and circumferentially displaced from the axis B'. A link 390 has a rearward end which is rotatably connected to the distal end of the member 361 and thereby defines a rotational axis D'. Simply by varying the size, configuration, and/or orientation of the member 361 and/or the link 390, any of various rotational link axes (D1–D3, for example) may be provided in place of the axis D.

An opposite, forward end of the link 390 is rotatably connected to a force receiving member 380 that rolls along an intermediate portion 408 of a rail 400. A rearward end 406 of the rail 400 is supported on the roller 370. On this embodiment 300, a discrete segment 407 separates or offsets the rearward end 406 and the intermediate portion 408. A forward end of the rail 400 is pivotally connected to a forward stanchion 330 on the frame 320 by means of a shaft 333. The handle member 430 is also pivotally connected to the forward stanchion 330 by means of the same shaft 333. As a result, the handle member 430 and the rail 400 independently pivot about a common pivot axis. The handle member 430 includes an upper, distal portion 434 which is sized and configured for grasping by a person standing on the force receiving member 380. In operation, the embodiment 300 allows a person to selectively perform arm exercise (by pivoting the handle 430 back and forth), while also performing leg exercise (by driving the force receiving member 380 through the path of motion P associated with the approximate center of the foot supporting surface).

Figure 10:
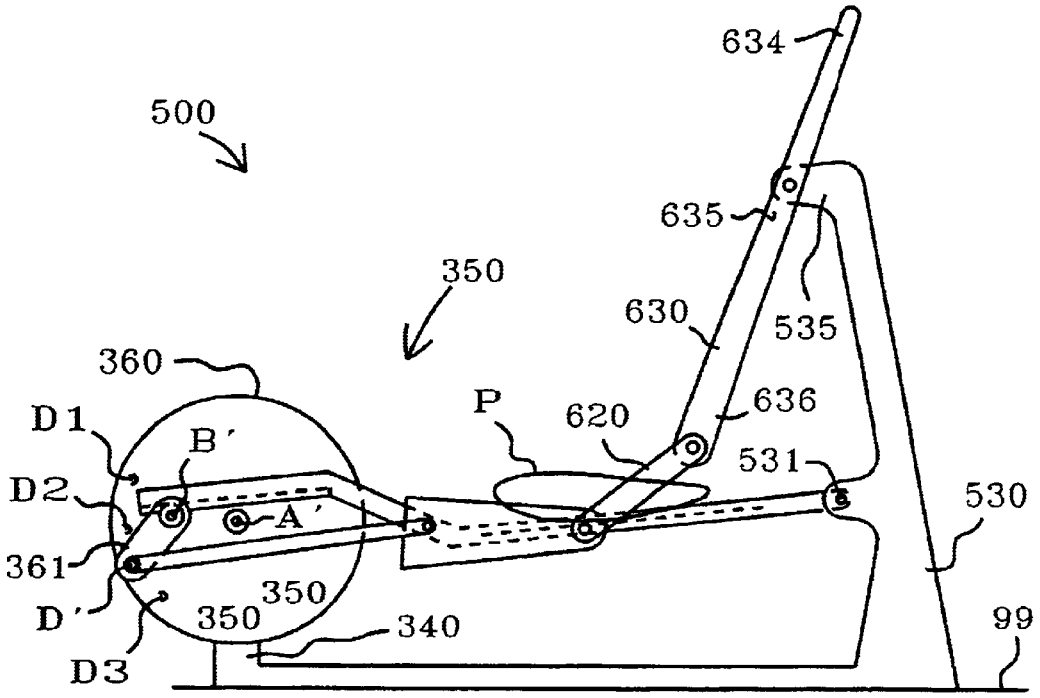
FIG. 10 is a side view of another embodiment of the present invention.

Yet another embodiment of the present invention is designated as 500 in FIG. 10. The exercise apparatus 500 includes left and right linkage assemblies 350 (identical to those of the alternative embodiment 300) movably mounted on a frame 520 and linked to respective handle members 630, which are also movably mounted on the frame 520. Again, for ease of illustration and discussion, only the right side of the machine 500 is shown and described.

A forward end of the rail 400 is pivotally connected to a first trunnion 531 on a forward stanchion 530, disposed at a first elevation above a floor surface 99. A handle member 630 has an intermediate portion 635 which is pivotally connected to a second trunnion 535 on the forward stanchion 530, disposed at a second, relatively greater elevation above the floor surface 99. An upper, distal portion 634 of the handle member 630 is sized and configured for grasping by a person standing on the force receiving member 380. A lower, distal portion 636 of the handle member 630 is rotatably connected to one end of a handle link 620. An opposite end of the handle link 620 is rotatably connected to the force receiving member 380. In operation, the handle link 620 links back and forth pivoting of the handle 430 to movement of the force receiving member 380 through the path of motion P.

Figure 11:
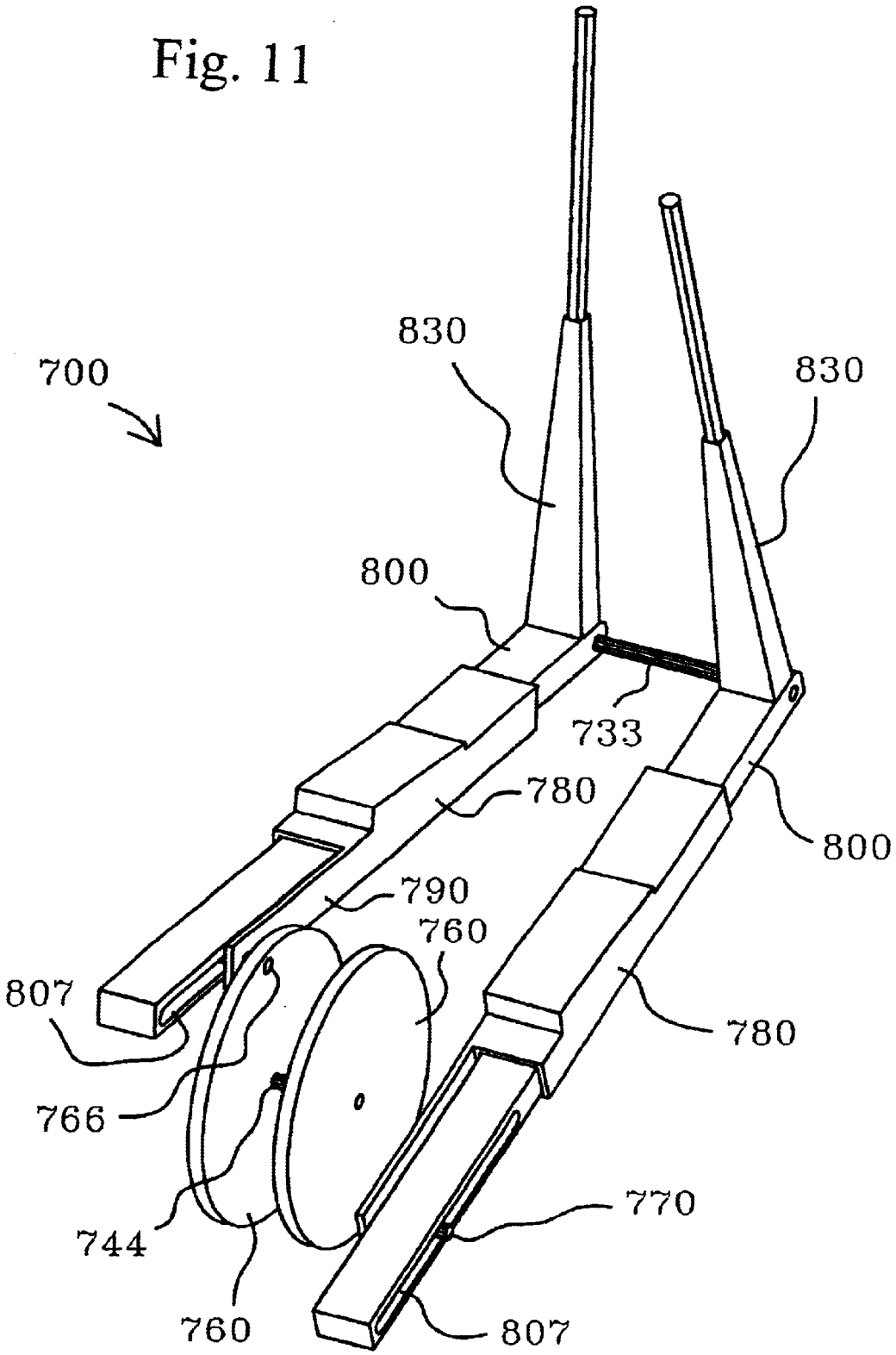
FIG. 11 is a perspective view of another embodiment of the present.invention.

Yet another linkage assembly arrangement, constructed according to the principles of the present invention, is shown in FIG. 11 (without an accompanying frame). Each of the linkage assemblies 700 is movably connected to a frame by means of a forward shaft 733 and a rearward shaft 744. Flywheels 760 are rotatably mounted on the shaft 744 and rotate relative to the frame. A rigid shaft 766 extends axially outward from a radially displaced point on each flywheel 760. Each shaft 766 extends through a hole in a link 790 to a distal end which supports a roller 770. Each roller 770 is disposed within a race or slot 807 formed in the rearward end of a rail 800. The forward end of each rail 800 is pivotally mounted on the shaft 733. In response to rotation of the flywheel 760, the rail 800 rolls across the roller 770 as the latter causes the former to pivot up and down about the shaft 733. The lower wall of the slot 807 limits upward travel of the rail 800 away from the roller 770.

Each link 790 extends forward and integrally joins a respective force receiving member 780 which is rollably mounted on a respective rail 800. In response to rotation of the flywheel 760, the shaft 766 drives the link 790 and the force receiving member 780 back and forth along the rail 800. A handle member 830 is rigidly mounted to the forward end of each rail 800 and pivots together therewith. As suggested by the machine 300 shown in FIG. 9, handle members could alternatively be pivotally mounted on the shaft 733, between the rails 800, for example, to pivot independently of the rails 800.

Figure 12:
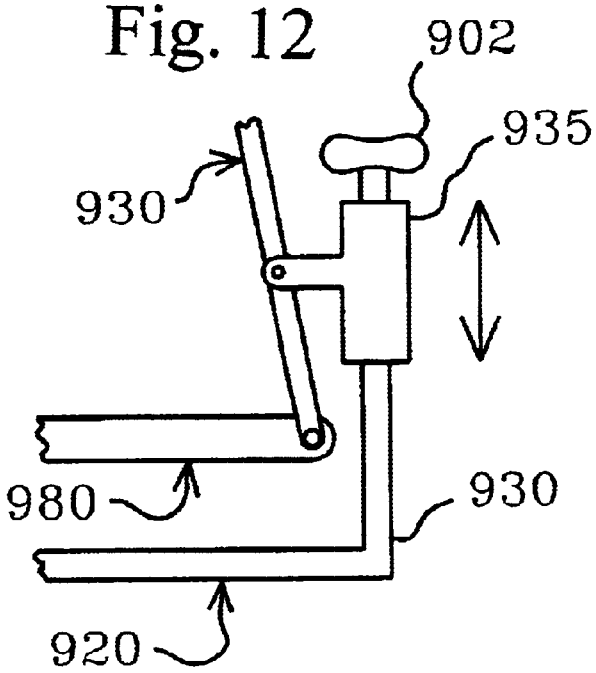
FIG. 12 is a diagrammatic side view of an inclination adjustment mechanism suitable for use on exercise apparatus constructed according to the present invention.

An alternative inclination adjustment mechanism (in lieu of the ball detent pins and selectively aligned holes described above) is shown diagrammatically in FIG. 12. As on several of the preceding embodiments, a frame 920 includes a support 935 which is movable along an upwardly extending stanchion 930, and a pivoting member or guide 930 is rotatably interconnected between the support 935 and a force receiving member 980. A knob 902 is rigidly secured to a lead screw which extends through the support 935 and threads into the stanchion 930. The knob 902 and the support 935 are interconnected in such a manner that the knob 902 rotates relative to the support 935, but they travel up and down together relative to the stanchion 930 (as indicated by the arrows) when the knob 902 is rotated relative to the stanchion 930.

Figure 13:
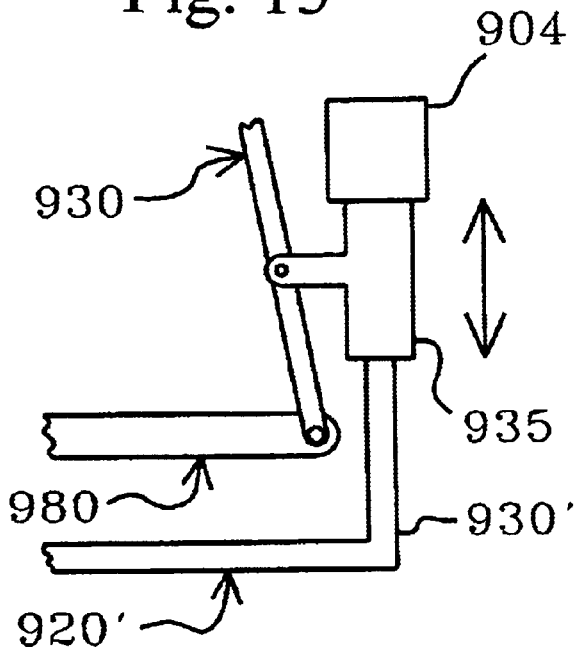
FIG. 13 is a diagrammatic side view of another inclination adjustment mechanism suitable for use on exercise apparatus constructed according to the present invention.
Figure 14:
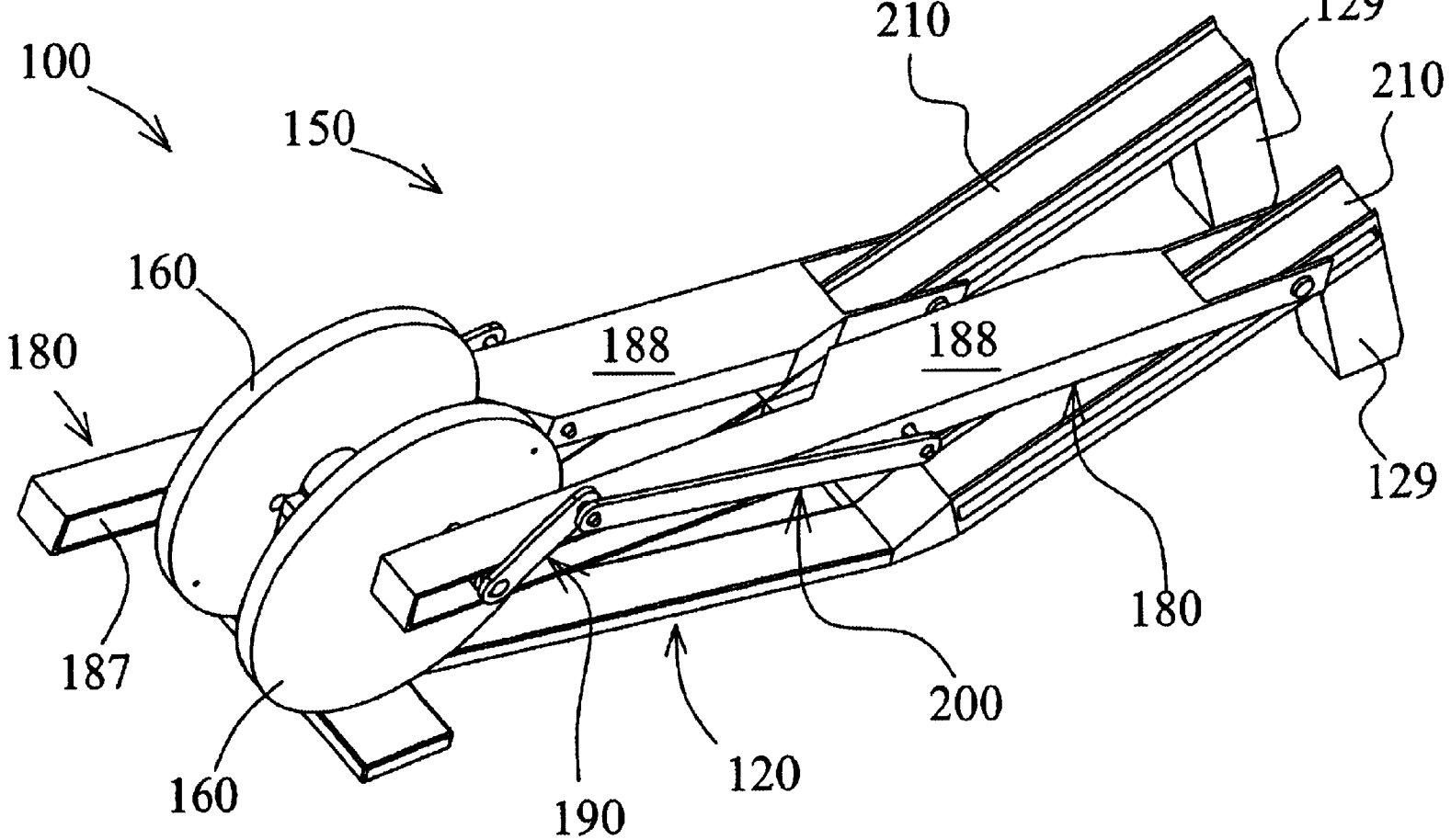
FIG. 14 is a perspective view of another exercise apparatus constructed according to the principles of the present invention.

Yet another suitable inclination adjustment mechanism is shown diagrammatically in FIG. 13, wherein a frame 920' includes a support 935 movable along an upwardly extending stanchion 930', and a pivoting member or guide 930 is rotatably interconnected between the support 935 and a force receiving member 980. A powered actuator 904, such as a motor or a hydraulic drive, is rigidly secured to the support 935 and connected to a movable shaft which extends through the support 935 and into the stanchion 930'. The actuator 904 selectively moves the shaft relative to the support 935, causing the actuator 904 and the support 935 to travel up and down together relative to the stanchion 930' (as indicated by the arrows). The actuator 904 may operate in response to signals from a person and/or a computer controller.

Another exercise apparatus constructed according to the principles of the present invention is designated as 1100 in FIGS. 14–19. The apparatus 1100 generally includes a frame 1120 and left and right linkage assemblies 1150 movably mounted on the frame 1120. Generally speaking, the linkage assemblies 1150 move relative to the frame 1120 in a manner that links rotation of left and right flywheels 1160 to generally elliptical motion of left and right force receiving members 1180.

Figure 15:
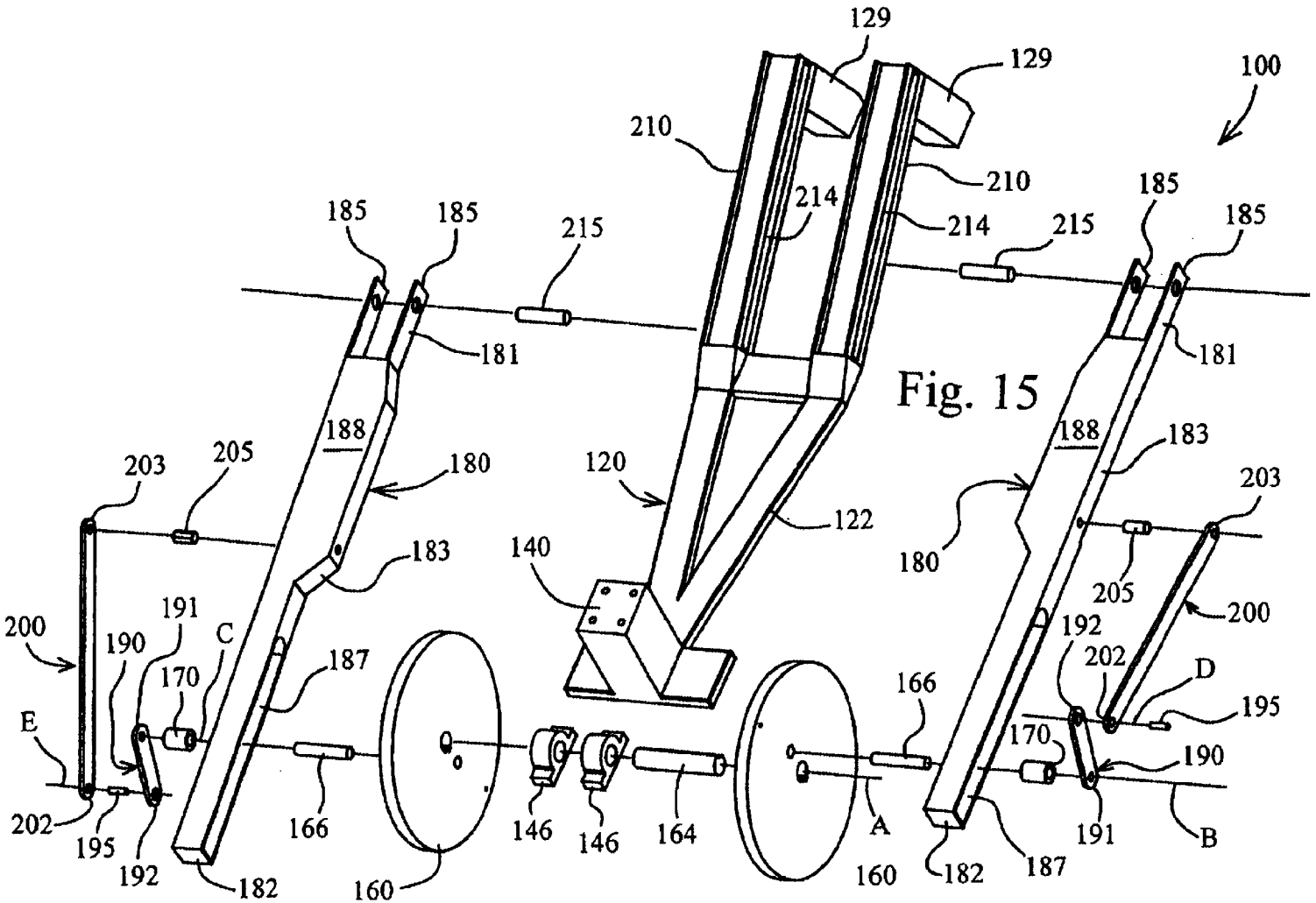
FIG. 15 is an exploded perspective view of the exercise apparatus of FIG. 14.
Figure 16:
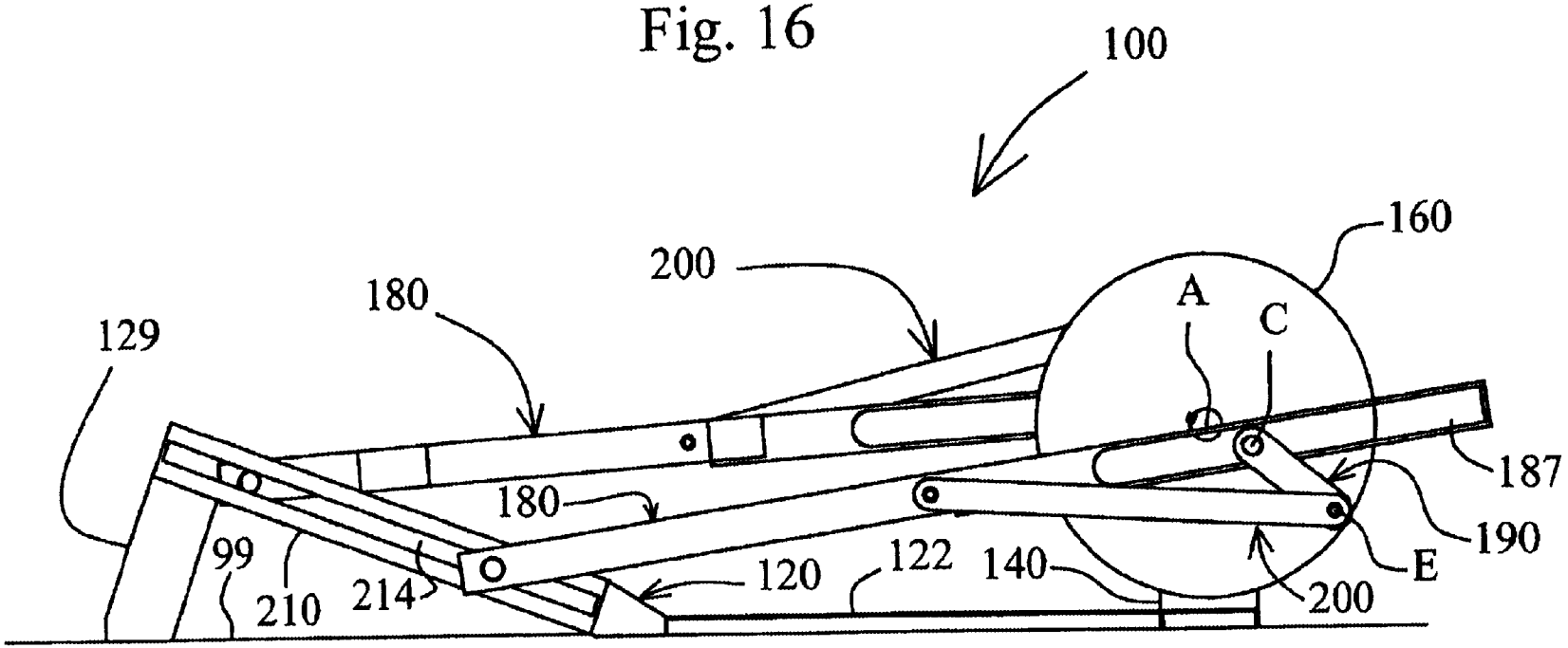
FIG. 16 is a side view of the exercise apparatus of FIG. 14.
Figure 17:
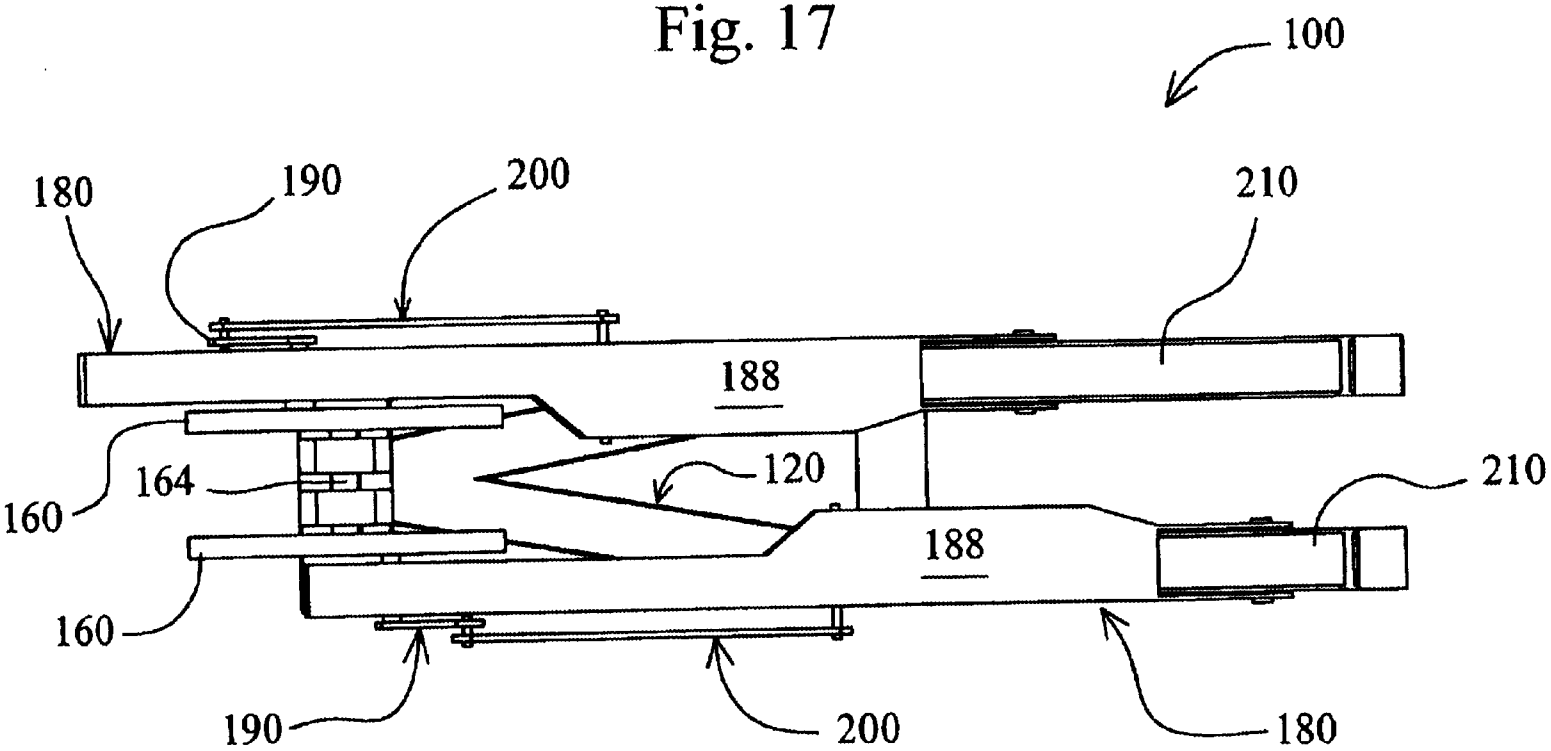
FIG. 17 is a top view of the exercise apparatus of FIG. 14.
Figure 18:
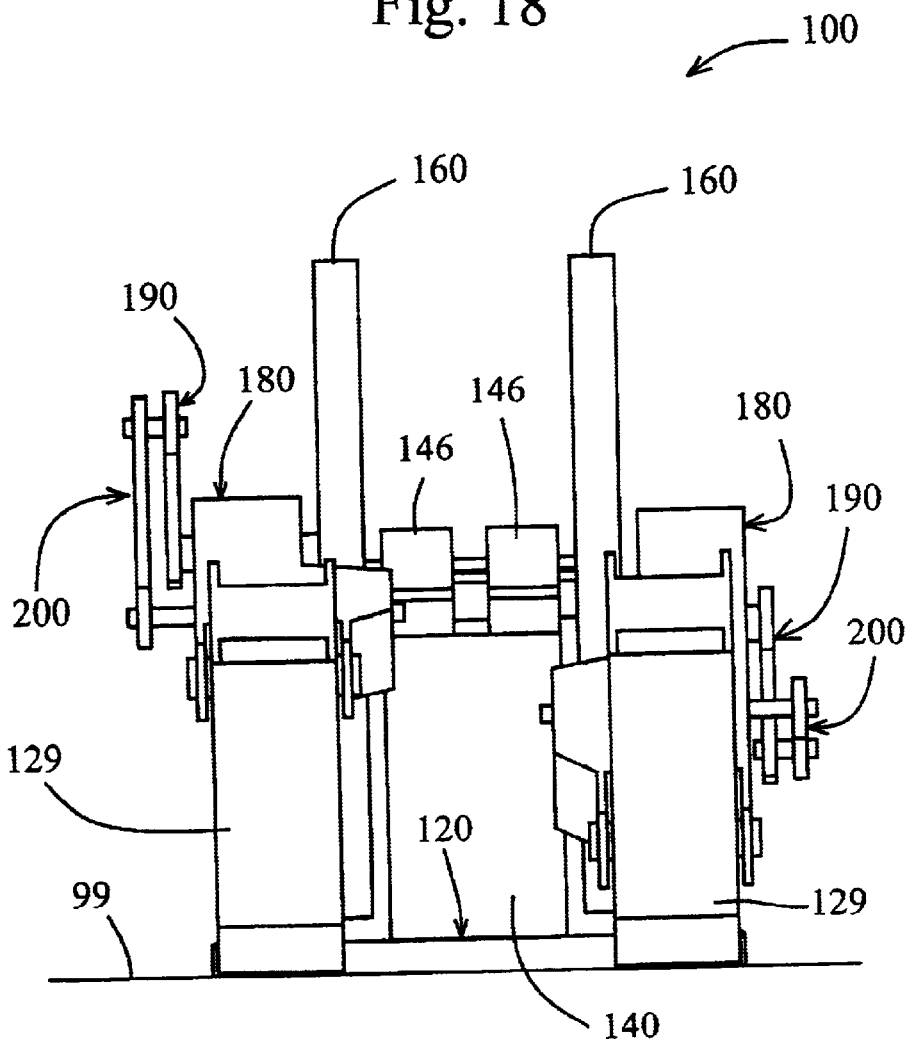
FIG. 18 is a front view of the exercise apparatus of FIG. 14.
Figure 19:
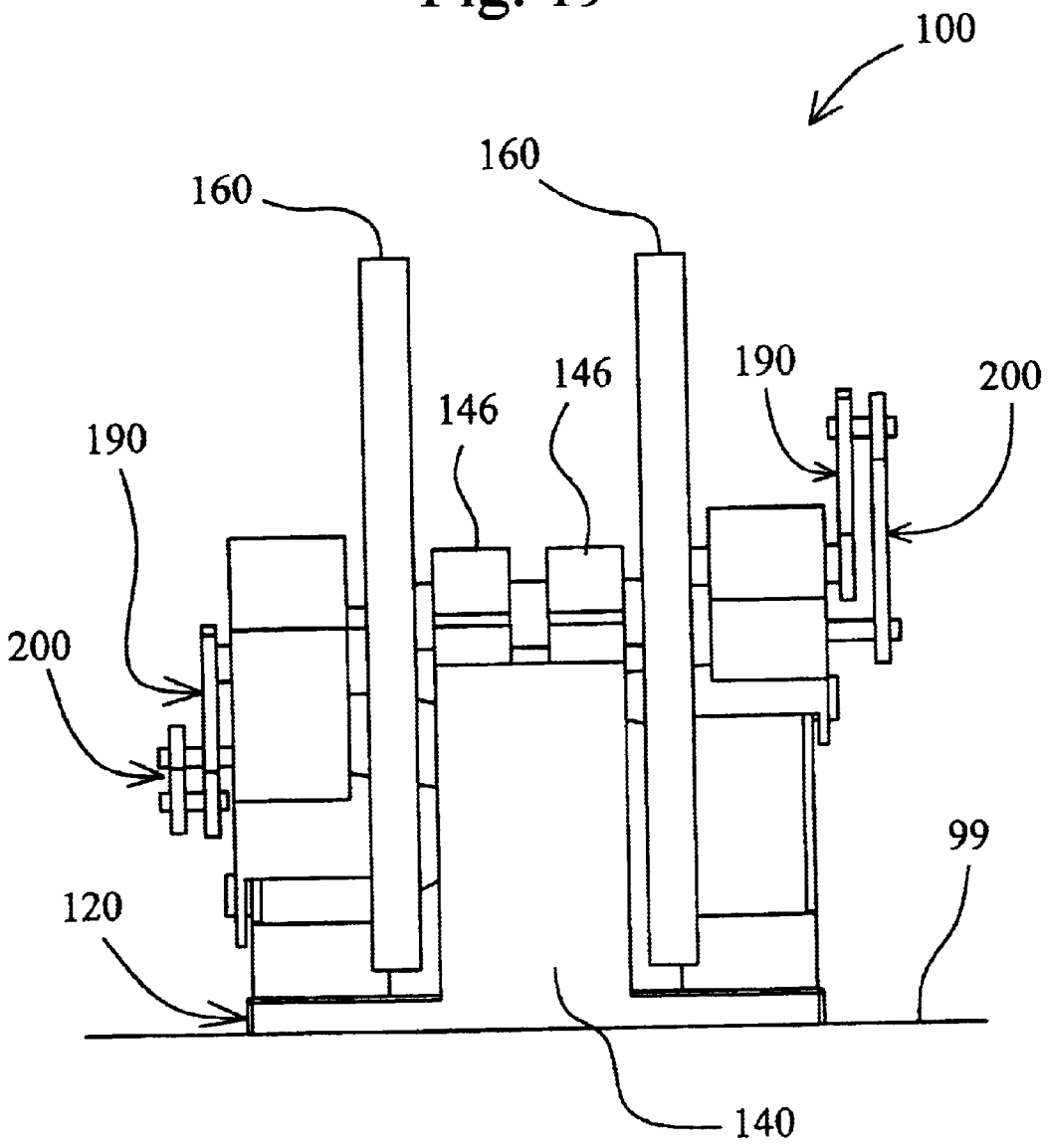
FIG. 19 is a rear view of the exercise apparatus of FIG. 14.

The frame 1120 includes a base 1122 which is designed to rest upon a.generally horizontal floor surface 99. As shown in FIG. 15, a rearward stanchion 1140 extends perpendicularly upward from the base 1122 and supports a pair of bearing assemblies 1146. An axle 1164 is inserted through holes (not numbered) in the bearing assemblies 1146 to support the flywheels 1160 in a manner known in the art. For example, the axle 1164 may be inserted through the bearing assemblies 1146, and then one of the flywheels 1160 may be fixed to each of the protruding ends of the axle 1164, on opposite sides of the stanchion 1140. Those skilled in the art will recognize that the flywheels 1160 could be replaced by some other rotating member(s) which may or may not, in turn, be connected to one or more flywheels. These rotating members 1160 rotate about an axis designated as A15.

On each side of the apparatus 1100, a radially displaced shaft 1166 is rigidly secured to the flywheel 1160 by means known in the art. For example, the shaft 1166 may be inserted into a hole (not numbered) in the flywheel 1160 and welded in place. The shaft 1166 is secured to the flywheel 1160 at a point radially displaced from the axis A15, and thus, the shaft 1166 rotates at a fixed radius about the axis A15. In other words, the shaft 1166 and the flywheel 1160 cooperate to define a first crank having a first crank radius.

Rollers 1170 are rotatably mounted on respective shafts 1166. The roller 1170 on the right side of the apparatus 1100 (from the perspective of a user standing on the force receiving members 1180 and facing away from the flywheels 1160) rotates about an axis B15, and the roller 1170 on the left side of the apparatus 1100 rotates about a diametrically opposed axis C15. On the embodiment 1100, each of the rollers 1170 has a smooth cylindrical surface which bears against and supports a rearward portion or end 1182 of a respective force receiving member 1180. In particular, the roller 1170 protrudes laterally into a slot 1187 provided in the rearward end 1182 of the force receiving member 1180. The height of the slot 1187 is greater than the diameter of the roller 1170, so the lower surface of the slot 1187 does not prevent the roller 1170 from rolling back and forth across the upper surface of the slot 1187. Other structures (e.g. the shaft 1166 and a low friction bearing surface) may be used in place of the roller 1170. In any event, the rollers may be said to be interconnected between the flywheels 1160 and the force receiving members 1180 and/or to provide means for interconnecting the flywheels 1160 and the force receiving members 1180.

On each side of the apparatus 1100, a rigid member or first link 1190 has a first end 1191 which is fixedly secured to the distal end of a respective shaft 1166 by means known in the art. The first link 1190 extends to a second, opposite end 1192 which occupies a position radially displaced from the axis A15, and which rotates at a fixed radius about the axis A15. In other words, the second end 1192 of the first link 1190 and the flywheel 1160, together with the parts interconnected therebetween, cooperate to define a second crank having an effective crank radius which is longer than the first crank. Those skilled in the art will recognize that the two "cranks" are portions of a single unitary member which is connected to the flywheel 1160 by the shaft 1166, and they share a common rotational axis A15.

On each side of the apparatus 1100, a second link 1200 has a rearward end 1202 rotatably connected to the second end 1192 of a respective first link 1190 by means known in the art. For example, holes may be formed through the overlapping ends 1192 and 1202, and a fastener 1195 may be inserted through the aligned holes and secured in place. As a result of this arrangement, the second link 1200 on the right side of the apparatus 1100 rotates about an axis D15 relative to its respective fastener 1195 and flywheel 1160; and the second link 1200 on the left side of the apparatus 1100 rotates about an axis E15 relative to its respective fastener 1195 and flywheel 1160. Those skilled in the art will recognize that the exact location of the axes D15 and E15 relative to the other axes A15, B15, and C15, as well as one another, may be varied to provide different paths of motion.

Each second link 1200 has a forward end 1203 rotatably connected to an intermediate portion 1183 of a respective force receiving member 1180 by means known in the art. For example, a pin 1205 may be secured to the force receiving member 1180, and a hole may be formed through the forward end 1203 of the second link 1200 to receive the pin 1205. As a result of this arrangement, the second links 1200 may be said to be rotatably interconnected between the flywheels 1160 and the force receiving members 1180, and/or to provide discrete means for interconnecting the flywheels 1160 and the force receiving members 1180.

Each force receiving member 1180 has a forward end 1181 which is movably connected to the frame 1120, as well as a rearward end 1182 (connected to a respective roller 1170) and an intermediate portion 1183 (connected to a respective second link 1200). In this regard, right and left rails or guides 1210 extend from relatively rearward ends, which are connected to the base 1122 proximate the floor surface 99, to relatively forward ends, which are supported above the floor surface 99 by posts. 1129. A longitudinally extending slot 1214 is provided in each rail 1210 to accommodate a respective bearing member 1215. The forward end 1181 of each force receiving member 1180 is provided with opposing flanges 1185 which occupy opposite sides of a respective rail 1210 and are connected to opposite ends of a respective bearing member 1215. In other words, the bearing member 1215 movably connects the force receiving member 1180 to the rail 1210 and/or may be described as a means for interconnecting the force receiving member 1180 and the frame 1120.

On the embodiment 1100, the bearing member 1215 is a roller which is rotatably mounted on the force receiving member 1180 and rollable across a bearing surface within the slot 1214. However, the bearing member could instead be a stud which is rigidly secured to the force receiving member and slidable across a low friction bearing surface within the slot. The intermediate portion 1183 of the force receiving member 1180 may be described as that portion between the first end 1181 and the second end 1182. In addition to connecting with the second link 1200, the intermediate portion 1183 provides a support surface 1188 which is sized and configured to support at least one foot of a person using the apparatus 1100.

In operation, rotation of the flywheel 1160 causes the shafts 1166 to revolve about the axis A15, and the rollers 1170 cause the support surfaces 1188 to move up and down relative to the frame 1120, through a range of motion approximately equal to the crank diameter (the distance between the axes B15 and C15). Rotation of the flywheels 1160 also causes the second ends 1192 of the first links 1190 to revolve about the axis A15, and the second links 1200 cause the support surfaces 1188 to move back and forth relative to the frame 1120, through a range of motion approximately equal to the distance between the axes D15 and E15 (which is greater than the crank diameter defined between the axes B15 and C15).

The apparatus 1100 is another example of how the present invention provides methods and apparatus for moving a force receiving member through a path having a horizontal component which is not necessarily related to or limited by the vertical component. As a result, it is a relatively simple matter to design an apparatus with a desired "aspect ratio" for the elliptical path to be traveled by the foot platform. For example, movement of the axes D15 and E15 farther from the axis A15 and/or movement of the axes B15 and C15 closer to the axis A15 will result in a relatively flatter path of motion. Ultimately, the exact size, configuration, and arrangement of the components of the linkage assembly 1150 are matters of design choice.

Figure 20A:
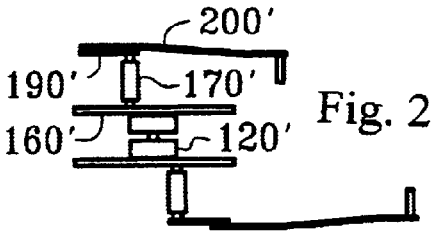
FIG. 20A is a top view of part of the linkage assembly on the exercise apparatus of FIG. 14.
Figure 20B:
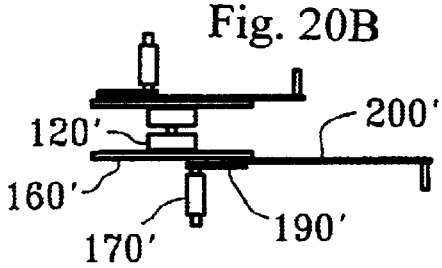
FIG. 20B is a top view of a linkage assembly similar to that of FIG. 20A, .showing a second, discrete arrangement of the linkage assembly components.
Figure 20C:
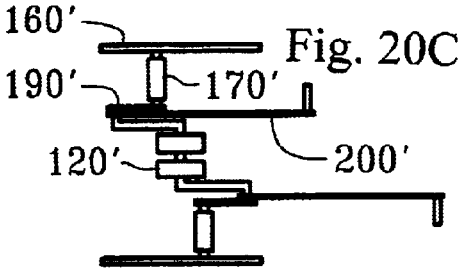
FIG. 20C is a top view of a linkage assembly similar to that of FIG. 20A, showing a third, discrete arrangement of the linkage assembly components.
Figure 20D:
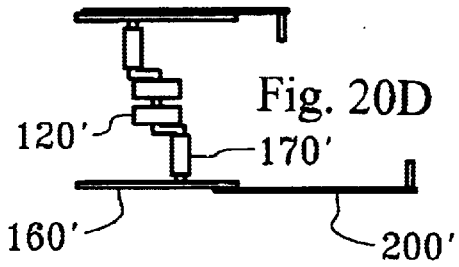
FIG. 20D is a top view of a linkage assembly similar to that of FIG. 20A, showing a fourth, discrete arrangement of the linkage assembly components.
Figure 20E:
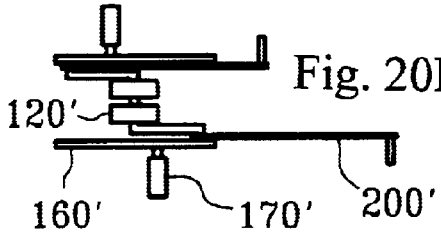
FIG. 20E is a top view of a linkage assembly similar to that of FIG. 20A, showing a fifth, discrete arrangement of the linkage assembly components.
Figure 20F:
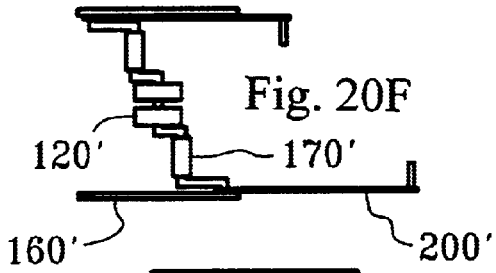
FIG. 20F is a top view of a linkage assembly similar to that of FIG. 20A, showing a sixth, discrete arrangement of the linkage assembly components.
Figure 20G:
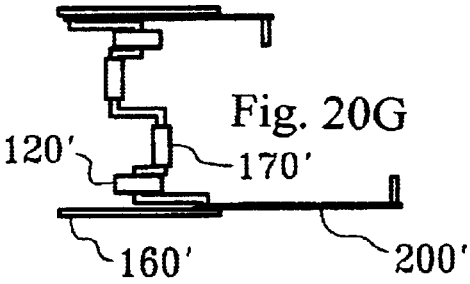
FIG. 20G is a top view of a linkage assembly similar to that of FIG. 20A, showing a seventh, discrete arrangement of the linkage assembly components.
Figure 20H:
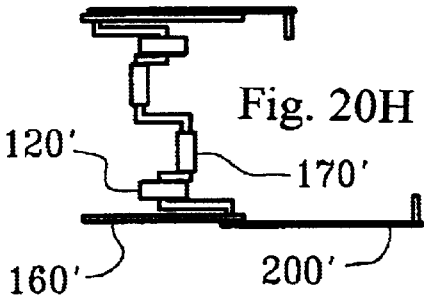
FIG. 20H is a top view of a linkage assembly similar to that of FIG. 20A, showing an eighth, discrete arrangement of the linkage assembly components.
Figure 20I:
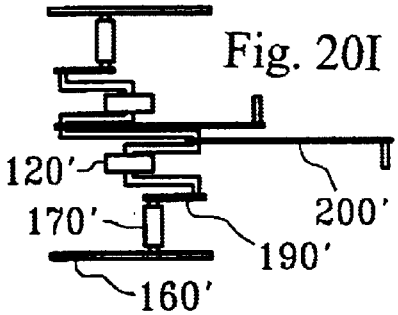
FIG. 20I is a top view of a linkage assembly similar to that of FIG. 20A, showing a ninth, discrete arrangement of the linkage assembly components.
Figure 20J:
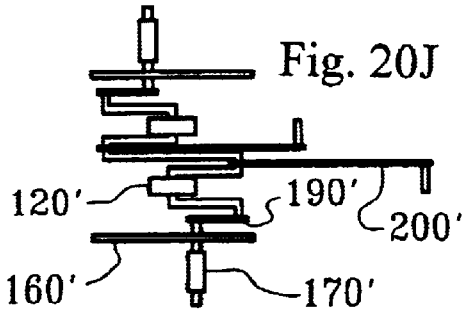
FIG. 20J is a top view of a linkage assembly similar to that of FIG. 20A, showing a tenth, discrete arrangement of the linkage assembly components.

Those skilled in the art will further recognize that the above-described components of the linkage assembly 1150 may be arranged in a variety of ways. For example, in each of FIGS. 20A–20J, flywheels 1160', support rollers 1170', links 1190', and links 1200' are shown in several alternative configurations relative to one another and the frame 1120' (in some embodiments, there is no need for a discrete link 1190' because both the links 1200' and the rollers 1170' are connected directly to the flywheels 1160'). FIGS. 20G and 20H show linkage arrangements wherein the foot supports are disposed adjacent one another and between both opposite side cranks and opposite side frame members.

Figure 22:
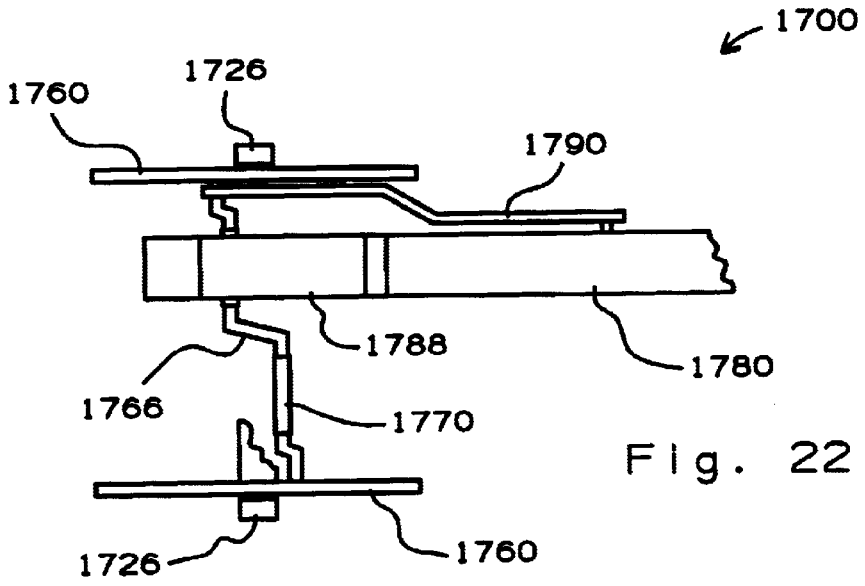
FIG. 22 is a partially fragmented, top view of the exercise apparatus of FIG. 21.
Figure 21:
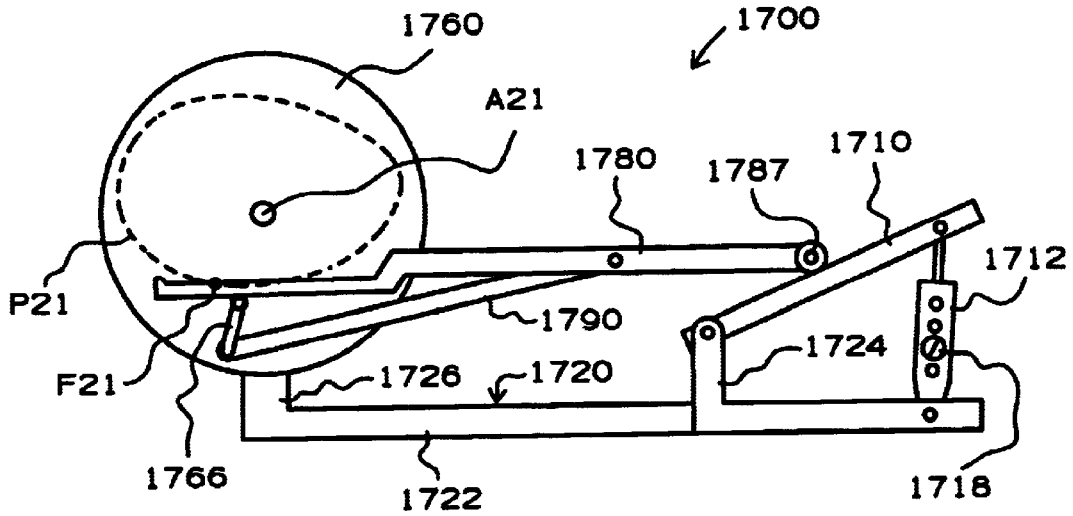
FIG. 21 is a side view of another embodiment of the present invention.

An "outboard crank" type machine 1700 having a linkage arrangement similar to those of FIGS. 20G and 20H is shown in greater detail in FIGS. 21–22. The machine 1700 similarly includes a frame 1720 having a base 1722 designed to rest upon a floor surface. An intermediate stanchion 1724 extends upward from the base 1722, and left and right rearward stanchions 1726 extend upward from the base 1722 proximate its rearward end. Left and right cranks 1760 (shown and described as discs for ease of illustration and discussion) are rotatably mounted to respective rearward stanchions 1726. A crank shaft 1766 is rigidly interconnected between the opposite side cranks 1760, thereby constraining the crank shaft 1766 and the cranks 1760 to rotate together about a common crank axis A21 relative to the frame 1720.

The crank shaft 1766 includes first axially extending portions, which are disposed proximate respective crank discs 1760, and which define a relatively larger crank diameter, and second axially extending portions, which are disposed proximate a central portion of the crank shaft 1766, and which define a relatively smaller crank diameter. Left and right rollers 1770 are rotatably mounted on respective second portions of the crank shaft 1766 to support rearward portions of respective left and right foot supporting members 1780 in "de-coupled" fashion relative to respective cranks 1760. The rearward portions of the foot supporting members 1780 are sized and configured to support the respective feet of a standing person. As a result of this arrangement, the rearward ends of the foot supporting members 1780 are constrained to move up and down together with the rollers 1770 but are free to move back and forth relative to the rollers 1770.

Opposite, forward ends of the foot supporting members 1780 are connected to respective rollers 1787 which are supported by a guide 1710. A rearward end of the guide 1710 is pivotally connected to the intermediate stanchion 1724, and a forward end of the guide 1710 is pivotally connected to an adjustable length member 1712. The adjustable length member 1712 includes a rod and a cylinder which are connected in one of several positions relative to one another by inserting a fastener 1718 through aligned holes in each. In this manner, the inclination of the guide 1710 may be adjusted to change the path traveled by the rollers 1787.

Left and right drawbars 1790 are pivotally coupled between respective foot supporting members 1780 and respective first portions of the crank shaft 1766. The drawbars 1790 link rotation of the cranks 1760 to back and forth movement of the foot supporting members 1780 relative to the frame 1720. Since the drawbars 1790 are driven at a larger crank diameter than the rollers 1770, the foot platforms 1788 move back and forth a greater amount than they move up and down, thereby establishing a generally elliptical path of motion. For example, FIG. 21 shows a path P21 which is traversed by a point on the upper surface of the foot platform 1788 which is intersected by the path P21. This path may be described as (a) encompassing the crank axis A21; (b) intersecting a cylinder of space defined between the crank paths; and/or (c) at least partially rearward of a vertical plane extending tangent to the forwardmost edges of the crank paths.

Figure 23:
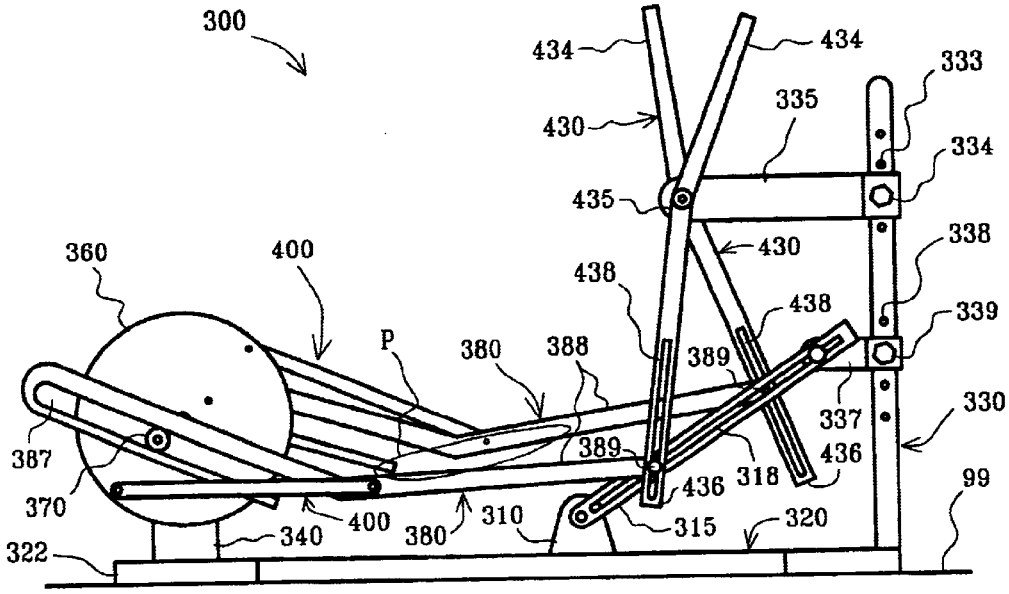
FIG. 23 is a side view of another embodiment of the present invention.

Another embodiment of the present invention is designated as 1300 in FIG. 23. The exercise apparatus 1300 includes a frame 1320 having a base 1322, a forward stanchion 1330, a rearward stanchion 1340, and an intermediate stanchion 1310. When the base 1322 is resting upon a floor surface 99, each of the stanchions 1310, 1330, 1340 extends generally upward from the base 1322.

On each side of the apparatus 1300, a flywheel 1360 is rotatably mounted on the rearward stanchion 1340, and a roller 1370 is rotatably mounted on the flywheel 1360 at a first radially displaced location. A rearward portion of a force receiving member 1380 rests upon the roller 1370. In particular, the rearward portion of the force receiving member is configured to define a slot 1387, and the roller 1370 protrudes laterally into the slot 1387 and bears against the upper wall or surface which borders the slot 1387.

On each side of the apparatus 1300, an intermediate portion of each force receiving member 1380 extends at an obtuse angle from the rearward portion and provides a foot supporting surface 1388. A first end of a rigid link 1400 is rotatably connected to the flywheel 1360 at a second radially displaced location. A second, opposite end of the link 1400 is rotatably connected to the intermediate portion of the force receiving member 1380.

On each side of the apparatus 1300, a roller 1389 is rotatably mounted on a forward end of a respective force receiving member 1380. The roller 1389 rolls or bears against a ramp 1315 having a first end rotatably connected to the intermediate stanchion 1310, and a second, opposite end connected to a trunnion 1337. A slot 1318 is provided in the ramp 1315 both to accommodate the roller 1389 and to facilitate angular adjustment of the ramp 1315 relative to the frame 1320 and the floor surface 99. With regard to the latter function, the trunnion 1337 is slidably mounted on the forward stanchion 1330, and a pin 1339 may be selectively inserted through aligned holes 1338 in the trunnion 1337 and the stanchion 1330 to secure the trunnion 1337 in any of several positions above the floor surface 99. As the trunnion 1337 slides along the stanchion 1330, the fastener which interconnects the trunnion 1337 and the ramp 1315 is free to move within the slot 1318.

On each side of the apparatus 1300, a lower portion 1436 of a handle member 1430 is movably connected to the forward end of a respective force receiving member 1380, adjacent the roller 1389. In particular, a common shaft extends through the force receiving member 1380, the roller 1389, and a slot 1438 provided in the lower portion 1436. An opposite, upper end of the handle member 1430 is sized and configured for grasping by a person standing on the force receiving member 1380. An intermediate portion 1435 of the handle member 1430 is rotatably connected to a trunnion 1335 which in turn, is slidably mounted on the forward stanchion 1330 above the trunnion 1337. A pin 1334 may be selectively inserted through any one of the holes 1333 in the trunnion 1335 and an aligned hole in the stanchion 1330 to secure the trunnion 1335 in any of several positions above the floor surface 99. The slot 1438 in the handle member 1430 both accommodates height adjustments and allows the handle member 1430 to pivot about its connection with the trunnion 1335 while the roller 1389 moves through a linear path of motion. As a result of this arrangement, the height of the handle member 1430 can be adjusted without affecting the path of the foot support 1380, and/or the path of the foot support 1380 can be adjusted without affecting the height of the handle member 1430, even though the two force receiving members 1380 and 1430 are linked to one another.

In view of the foregoing, the apparatus 1300 may be said to include means for linking rotation of the cranks 1360 to generally elliptical motion of the force receiving members 1380 (through a path P21), and/or means for linking the generally elliptical motion of the force receiving members 1380 to reciprocal motion of discrete force receiving members 1430.

Figure 24:
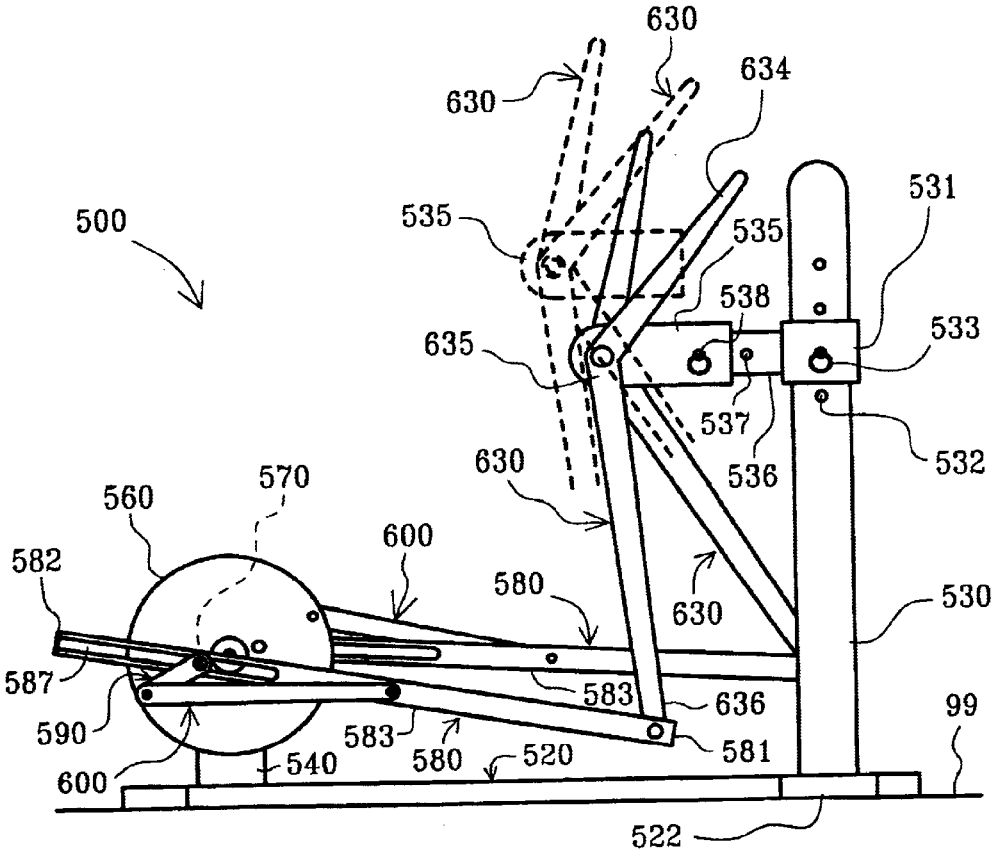
FIG. 24 is a side view of another embodiment of the present invention.
Figure 25:
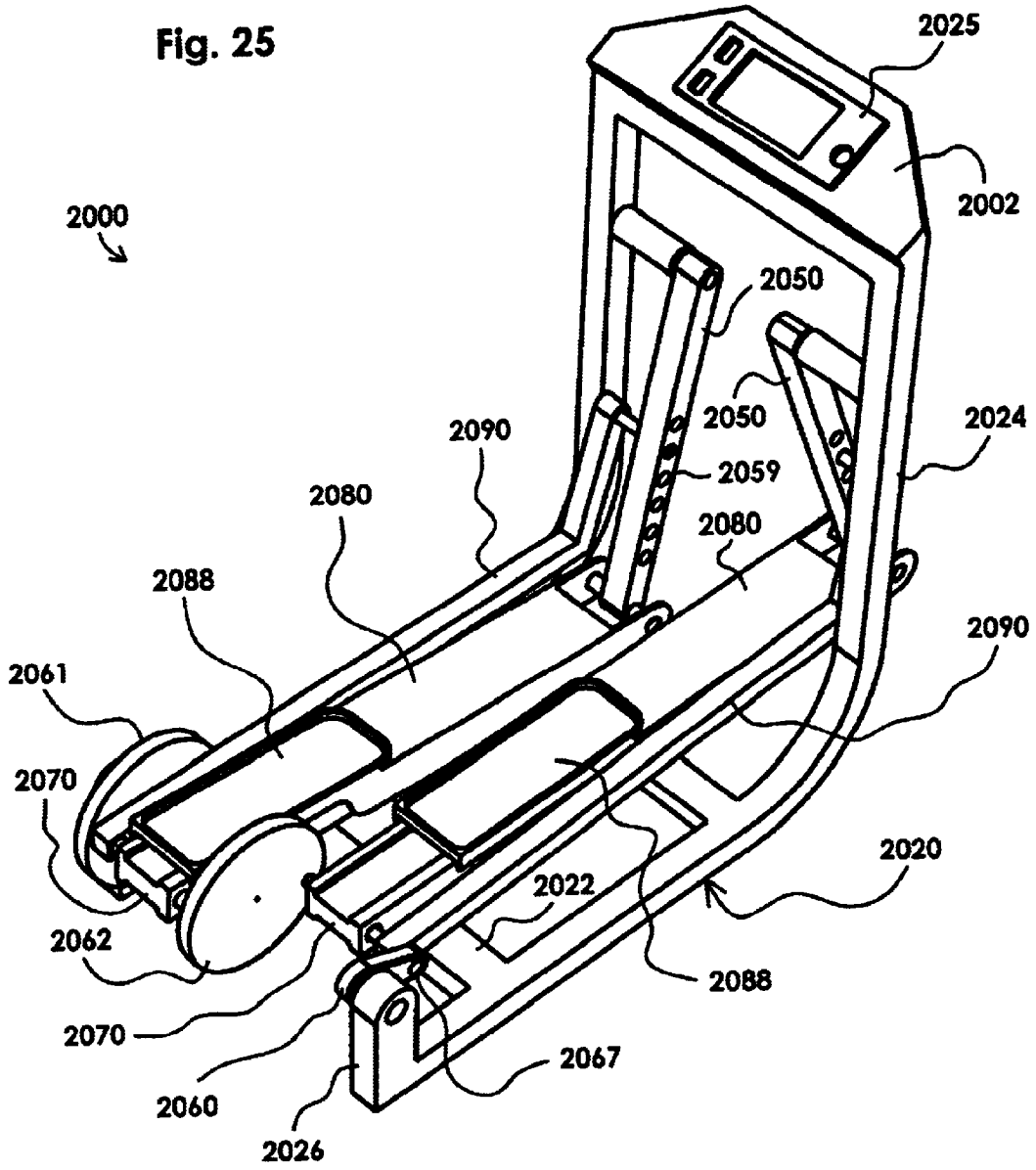
FIG. 25 is a perspective view of another exercise apparatus constructed according to the principles of the present invention.
Figure 26:
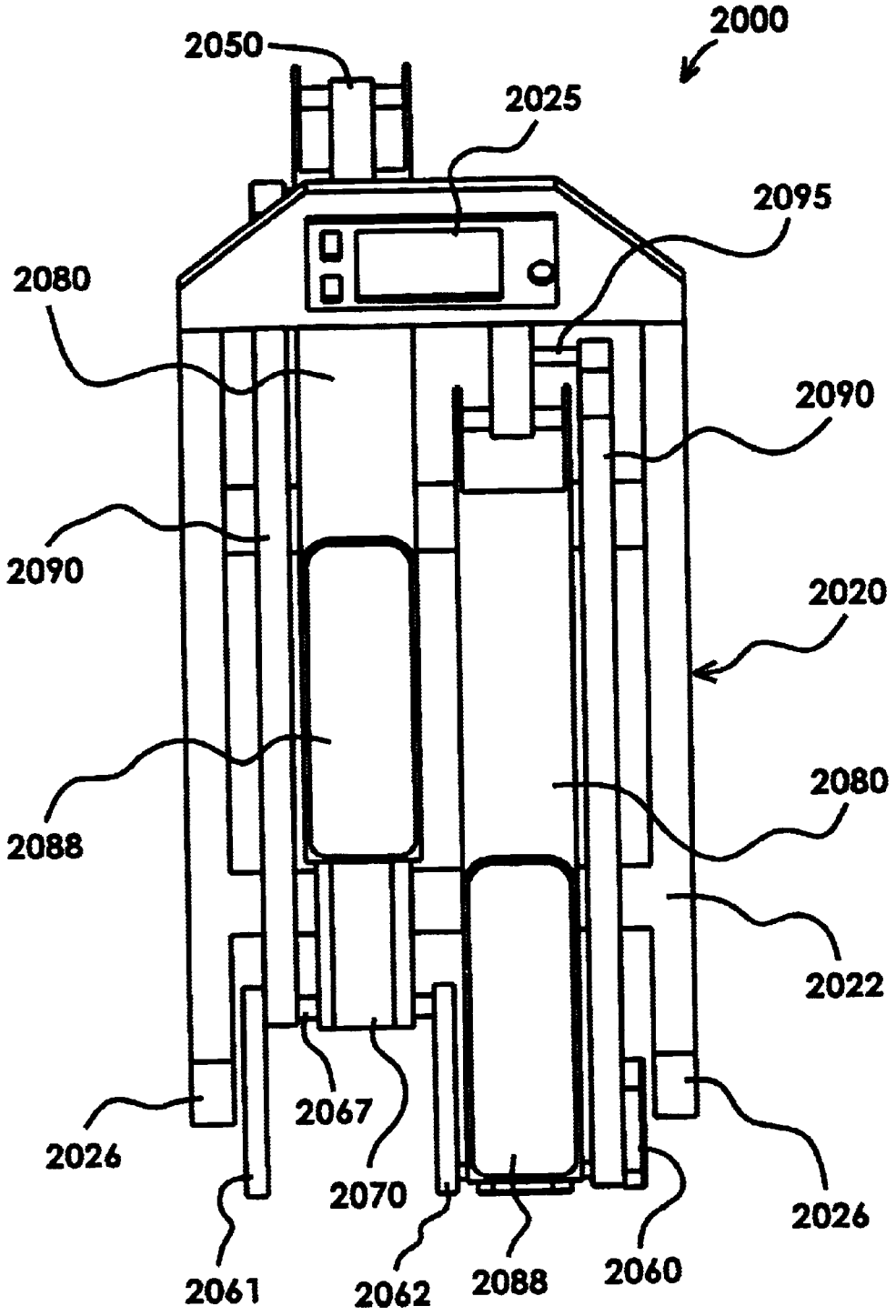
FIG. 26 is a top view of the exercise apparatus of FIG. 25.

Yet another embodiment of the present invention is designated as 1500 in FIG. 24. The exercise apparatus 1500 includes a frame 1520 having a base 1522, a forward stanchion 1530, and a rearward stanchion 1540. The base 1522 is configured to rest upon a floor surface 99, and each of the stanchions 1530 and 1540 extends generally perpendicularly upward from the base 1522.

Left and right flywheels 1560 are rotatably mounted on the rearward stanchion 1540, and rollers 1570 are rotatably mounted on respective flywheels 1560 at diametrically opposed locations. On each side of the apparatus 1300, a rearward portion 1582 of a force receiving member 1580 rests upon a respective roller 1570. In particular, the rearward portion 1582 of the force receiving member 1580 is configured to define a slot 1587, and the roller 1570 protrudes laterally into the slot 1587 and bears against the upper wall or surface which borders the slot 1587.

On each side of the apparatus 1500, a first rigid link 1590 has a first end rigidly secured to the shaft which supports a respective roller 1570, and a second, opposite end which occupies a second radially displaced position relative to the crank axis. A first end of a second rigid link 1600 is rotatably connected to the second end of the first link 1590. A second, opposite end of the second rigid link 1600 is rotatably connected to an intermediate portion 1583 of the force receiving member 1580. The intermediate portion 1583 is sized and configured to support a person's foot.

A forward end 1581 of each force receiving member 1580 is rotatably connected to a lower end 1636 of a respective third link or pivoting handle member 1630. An opposite, upper end 1634 of each handle member 1630 is sized and configured for grasping by a person standing on the intermediate portions 1583 of the force receiving members 1580. An intermediate portion 1635 of each handle member 1630 is rotatably connected to a trunnion 1535 on the frame 1520. The trunnion 1535 is slidably mounted on a laterally extending support 1536, which in turn, is slidably mounted on the forward stanchion 1530. A pin 1533 inserts through aligned holes 1532 in the stanchion 1530 and the support 1536 to secure the support 1536 (and the trunnion 1535) at any one of a plurality of distances above the floor surface 99. A pin 1538 inserts through aligned holes 1537 in the support 1536 and the trunnion 1535 to secure the trunnion 1535 at one of a plurality of distances from the forward stanchion 1530. As a result of this arrangement, the handle members 1630 may be said to be rotatably interconnected between the force receiving members 1580 and the frame 1520 and/or to provide a means for interconnecting the force receiving members 1580 and the frame 1520.

Figure 31:
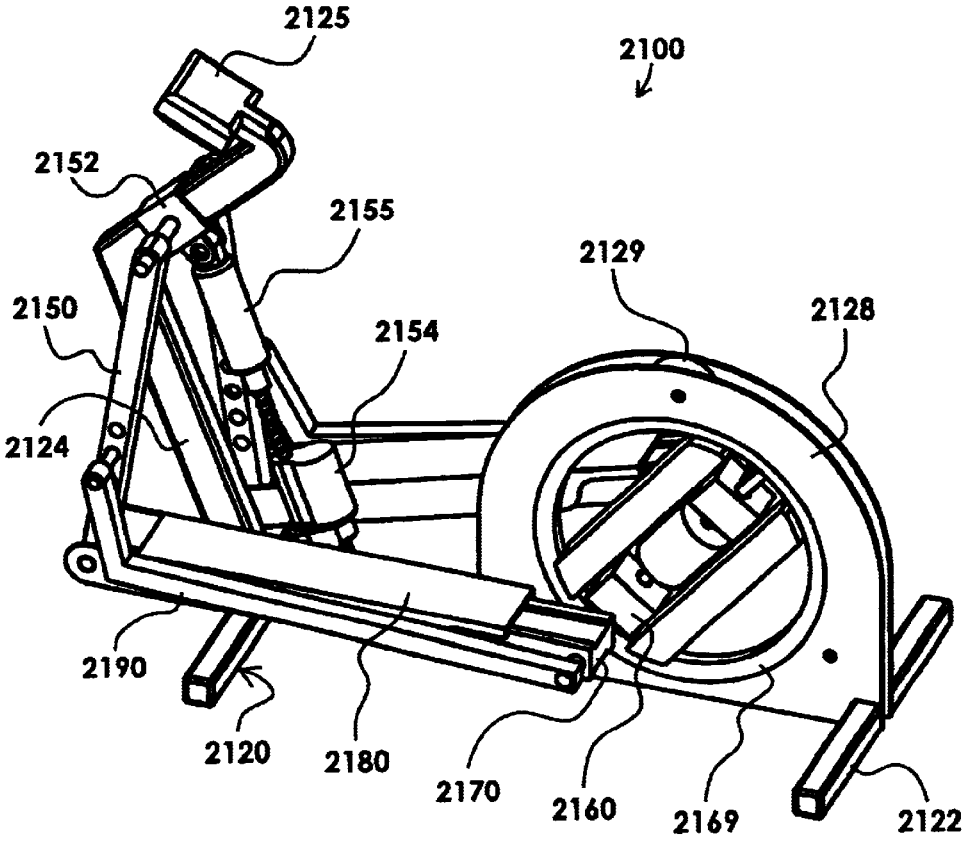
FIG. 31 is a perspective view of another embodiment of the present invention.

Those skilled in the art will recognize additional methods and/or embodiments which differ from those described above, yet nonetheless fall within the scope of the present invention. Among other things, the "outboard crank" machines may be designed in the alternative as "inboard crank" machines. For example, one such inboard crank machine is designated as 2100 in FIG. 31. The machine 2100 has left and right linkage assemblies which are generally similar to those on the first machine 2000 described in detail above.

The machine 2100 includes a frame 2120 having a base 2122 designed to rest upon a horizontal floor surface. A forward stanchion 2124 extends upward from a forward end of the base 2122, and a rearward crank support 2128 extends upward from an opposite, rearward end of the base 2122. The crank support 2128 supports three circumferentially spaced rollers 2129 which in turn, support a rim 2169 therebetween. An adjustable crank assembly is mounted on the rim 2169 and operates in a manner disclosed in one of the patents incorporated herein by reference.

Rearward ends of left and right rails 2170 are rotatably mounted to diametrically opposed crank members 2160 on respective sides of the crank support 2128. Opposite, forward ends of the rails 2170 are rollably mounted to respective foot supporting members 2180. Forward ends of the foot supporting members 2180 are rotatably mounted to respective rocker links 2150. Relatively upper portions of the rocker links 2150 are pivotally connected to a bracket 2152 which in turn, is selectively movable along a portion of the stanchion 2124. A user interface 2125 is mounted on top of the stanchion 2124 and connected to a motor 2154. An adjustable length member 2155, such as a lead screw, is interconnected between the motor 2154 and the bracket 2152 and operable to move the bracket 2152 along the stanchion 2124.

Left and right drawbar links 2190 are rotatably interconnected between respective crank members 2160 and respective rocker links 2150. The rocker connection points associated with the foot supporting members 2180 are relatively lower than the rocker connection points associated with the rocker links 2190. As a result of this arrangement, the forward ends of the drawbar links 2190 are constrained to pivot through first, relatively smaller arcs, and the forward ends of the foot supporting members 2180 are constrained to pivot through second, relatively longer arcs. The positions of the drawbar links 2190 relative to the rocker links 2150 may be adjusted to change the ratio defined by the two arc lengths.

The machine 2100 is configured so that a gap of less than four inches is defined between the foot supporting members 2180. As a result, the user's feet are movable through generally elliptical paths on opposite sides of the crank assembly. Generally speaking, the vertical component of the foot motion is a function of the crank diameter, and the horizontal component of the foot motion is a function of the positioning of the drawbar links 2190 relative to the rocker links 2150.

Figure 32:
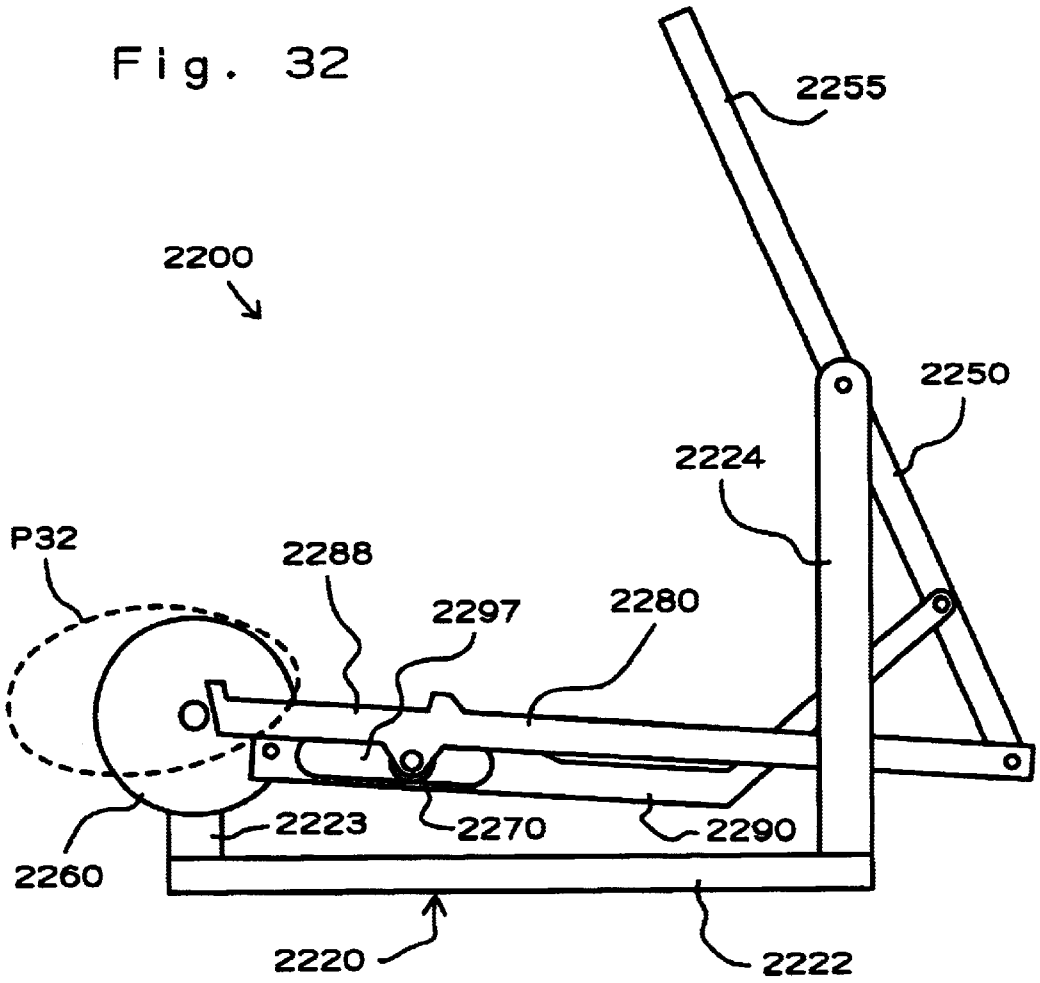
FIG. 32 is a sectioned side view of another embodiment of the present invention.

Those skilled in the art will also recognize that other types of "decoupled" linkage arrangements may be used to guide a user's feet through elliptical paths which laterally overlap with the circular paths of the cranks and/or encompass the crank axis. For example, another outboard crank machine constructed according to the principles of the present invention is designated as 2200 in FIG. 32. The machine 2200 includes a frame 2220 having a base 2222 designed to rest upon a horizontal floor surface. A rearward stanchion 2223 extends upward from a rearward end of the base 2222 and rotatably supports left and right cranks 2260. A forward stanchion 2224 extends upward from a forward end of the base 2222 and pivotally supports left and right rocker links 2250.

Rearward ends of left and right rails 2290 are rotatably mounted to respective cranks 2260, and opposite, forward ends of the rails 2290 are pivotally connected to respective rocker links 2250. Rearward ends of the foot supporting members 2280 are supported by respective rollers 2270 which in turn, are supported by respective rails 2290. Opposite, forward ends of the foot supporting members 2280 are rotatably mounted to respective rocker links 2150, at relatively lower positions than the rails 2290. Foot platforms 2288 are provided on the rearward ends of the foot supporting members 2280 to support the feet of a standing person. The resulting linkage assemblies guide a person's feet through the path P32.

The machine 2100 is configured so that a gap of less than four inches is defined between the foot supporting members 2180. As a result, the user's feet are movable through generally elliptical paths on opposite sides of the crank assembly. Generally speaking, the vertical component of the foot motion is a function of the crank diameter, and the horizontal component of the foot motion is a function of the positioning of the drawbar links 2190 relative to the rocker links 2150.

The foregoing description and drawings set forth only some of the possible implementations of the present invention. Among other things, the user's feet may also be directed rearward of the forwardmost crank positions and/or the crank axis by elevating the paths traveled by the foot supports relative to the cranks. Recognizing that numerous improvements and/or variations are made possible by this disclosure, the scope of the present invention is to be limited only to the extent of the claims which follow.

What is claimed is:

1. An exercise apparatus, comprising:

a frame having a base designed to rest upon a floor surface, a left crank support, and a right crank support;

a left crank and a right crank, wherein each said crank is rotatably connected to a respective crank support, and each said crank is disposed between said left crank support and said right crank support;

at least one support member on said frame; and a left linkage and a right linkage, wherein each said linkage includes a respective foot engaging portion, and each said linkage is movably interconnected between a respective crank and said at least one support member in such a manner that all points on each said foot engaging portion are movable through respective, generally elliptical paths, and at least one of said paths extends between the left crank-and the right crank.

2. The exercise apparatus of claim 1, wherein said left crank and said right crank rotate about a common crank axis and cooperate to define a crank diameter, and at least a portion of each said foot engaging portion is movable to a position less than one-half said crank diameter from said crank axis.

3. The exercise apparatus of claim 2, wherein at least a portion of each said foot engaging portion is movable through a substantially elliptical path about said crank axis.

4. The exercise apparatus of claim 1, wherein said at least one support member includes a left rocker link and a right rocker link pivotally coupled to said frame, and each said linkage includes a drawbar link which is pivotally coupled between a respective rocker link and a respective crank, and a forward portion of each said foot engaging portion is pivotally coupled to a respective rocker link, and a rearward portion of each said foot engaging portion is supported in decoupled fashion by a respective crank, whereby each said rearward portion remains free to move fore and aft relative to a respective crank.

5. The exercise apparatus of claim 4, wherein each said rocker link pivots about a common pivot axis relative to said frame, and each said drawbar link is connected to a respective rocker link at a first distance from said pivot axis, and each said foot engaging portion is connected to a respective rocker link at a second, relatively greater distance from said pivot axis.

6. The exercise apparatus of claim 4, wherein said left crank and said right crank rotate about a common crank axis and cooperate to define a crank diameter, and at least a portion of each said foot engaging platform is movable to a position less than one-half said crank diameter from said crank axis.

7. The exercise apparatus of claim 6, wherein at least a portion of each said foot engaging platform is movable in a substantially elliptical path about said crank axis.

* * * * *